US007504586B2

(12) United States Patent
Kamata et al.

(10) Patent No.: US 7,504,586 B2
(45) Date of Patent: Mar. 17, 2009

(54) CABLE AND CABLE IDENTIFICATING METHOD

(75) Inventors: Takeshi Kamata, Shizuoka (JP); Makoto Katsumata, Shizuoka (JP); Keigo Sugimura, Shizuoka (JP); Shigeharu Suzuki, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/536,458

(22) PCT Filed: Nov. 14, 2003

(86) PCT No.: PCT/JP03/14499

§ 371 (c)(1),
(2), (4) Date: May 25, 2005

(87) PCT Pub. No.: WO2004/049354

PCT Pub. Date: Jun. 10, 2004

(65) Prior Publication Data

US 2006/0021785 A1 Feb. 2, 2006

(30) Foreign Application Priority Data

Nov. 27, 2002 (JP) ..... 2002-343772

(51) Int. Cl.
*H01B 7/36* (2006.01)

(52) U.S. Cl. ..... 174/112

(58) Field of Classification Search ..... 174/112
See application file for complete search history.

(56) References Cited

U.S. PATENT DOCUMENTS

| | | | | | |
|---|---|---|---|---|---|
| 1,931,610 | A | * | 10/1933 | Johnstone | 428/382 |
| 2,106,048 | A | | 1/1938 | Candy, Jr. | 173/264 |
| 2,989,943 | A | * | 6/1961 | Fitzgerald et al. | 118/314 |
| 3,197,554 | A | * | 7/1965 | Baker | 174/112 |
| 4,313,394 | A | * | 2/1982 | North et al. | 118/323 |

FOREIGN PATENT DOCUMENTS

| | | | |
|---|---|---|---|
| JP | 59-20520 | | 2/1984 |
| JP | 06-150730 | * | 5/1994 |
| JP | 6-190315 | | 7/1994 |
| JP | 9-73820 | | 3/1997 |
| JP | 10-31918 | | 2/1998 |
| JP | 11-27817 | | 1/1999 |
| JP | 11-297129 | | 10/1999 |
| JP | 2003-168329 | | 6/2003 |

* cited by examiner

*Primary Examiner*—Chau N Nguyen
(74) *Attorney, Agent, or Firm*—Kratz, Quintos & Hanson, LLP

(57) ABSTRACT

Covered wires easily distinguished from each other on a low cost and a method of distinguishing the covered wires are provided. The first covered wire (1) has a core (5) and a cover portion (6). An outer surface (6*a*) of the cover portion (6) is unicolor (P). The first mark (7) and the second mark (8) are disposed with a gap on the outer surface (6*a*) along lengthwise of the first covered wire (1). The first mark (7) is colored with the first color (R). The second mark (8) is colored with the first color (G). The first covered wires (1) can be distinguished by properly selecting the first color (R) and the second color (G).

21 Claims, 13 Drawing Sheets

CABLE AND CABLE IDENTIFICATING METHOD

BACKGROUND OF THE INVENTION

1. Field of the Invention

This invention relates to a covered wire having an electrical conductive core and an insulating cover portion for covering said core, and a method of distinguishing the covered wires from each other.

2. Description of the Related Art

Various electronic apparatuses are mounted in a car as a vehicle. A wire harness is wired in the car to supply electric power from an electric source to the electronic apparatuses and transmit control signals from a computer thereto. The wire harness has a plurality of covered wires 100 (shown in FIG. 13A, 13B) and a connector joined with an end of the covered wires 100.

The covered wire 100 includes an electric conductive core 101 and a cover portion 102 of insulating synthetic resin for covering the core 101, as shown in FIG. 13A, 13B. The covered wire is called as covered wire. The covered wire 100 is manufactured by coating extruded insulating synthetic resin around the core 101. The covered wire 100 is colored by adding required coloring material into the synthetic resin when coating the covered wire.

The connector includes electrical-conductive terminals and a connector housing. The terminal is mounted to an end of the covered wire 100 so as to be joined electrically with the core 101 of the covered wire 100. The connector housing is formed into a box shape for receiving the terminals.

For assembling the wire harness, firstly the covered wire 100 is cut so as to have a required length, and the terminal is mounted at the end of the covered wire 100. If required, the some covered wires 100 are joined to each other. Thereafter, the terminal is inserted into the connector housing. Thus, the wire harness is assembled.

The covered wires 100 of the wire harness have to be distinguished with regard to diameters thereof, materials for the cover portions 102 (various materials such as heat-resistant or not), and purposes for use. The purposes for use are as a control signal for an airbag, ABS (Antilock Brake System) or car speed information, and for a car system such as a power transmission system in which the covered wire 100 is used.

For distinguishing the purposes for use (systems), an outer surface 102*a* of the cover portion 102 of the covered wire 100 shown in FIG. 13 is colored in stripe pattern with two different colors A, B (shown by hatching pattern in FIG. 13A, 13B). The covered wire 100 shown in FIG. 13A, 13B is manufactures by adding coloring material of color A into extruded synthetic resin for covering the core and, thereafter, coloring a part of the outer surface 102*a* with colorant of color B.

A color A part and a color B part of the covered wire shown in FIG. 13A, 13B are in parallel to each other along lengthwise of the covered wire 100 and disposed around the covered wire 100. The width of the color B part is narrower than the width of the color A part so that the area of the color A part is larger than the area of the color B part.

The car has many various requirements brought by users. Therefore, cars are required to install more various electronic apparatuses therein. In case, for example a hundred kinds of the covered wires 100 are used in the wire harness, and many colored covered wires with various colors are used.

Many various combinations of color A of coloring material added into the synthetic resin for the cover portion 102 and color B of colorant for coloring the cover portion after covering are applied for the covered wires 100 shown in FIG. 13A, 13B. Covered wires 100 having various wire-diameters are used in the wire harness. A band mark 103 is formed by coloring around the outer surface of the cover portion at the end of the covered wire 100 shown in FIG. 13A, 13B with color C different from the colors A, B. The band mark 103 are formed into circular shape (ring shape). The covered wire 100 shown in FIG. 13A, 13B can be distinguished about the wire diameter by existence of the band mark 103.

On the other hand, the weight of the wire harness may be increased in proportion of increasing various electronic apparatuses mounted in the car. Then, the covered wires 100 are expected to be thinner for lightening the wire harness. However, it becomes difficult to distinguish the combinations of colors A and B, because the color A part and the color B part are made narrow when the diameter of the covered wire 100 colored in stripe pattern as shown in FIG. 13A, 13B is made thinner. Thereby, incorrect wiring of the covered wires 100 may be possibly increased when the wire harness is assembled so that the quality of the wire harness may be reduced.

When the wire harness in the car is assembled with the usual covered wires 100, more than hundred kinds of the covered wires 100 colored with combinations of color A and B are required. Therefore, many processes and more space for storing the more than hundred kinds of the covered wires 100 in a manufacturing site for the covered wires 100 and assembling site for the wire harness.

Thereby, a cost of a product using the covered wires 100, such as a harness, may be increased. The applicant of this invention already proposed the other manufacturing process comprising steps of pre-producing unicolor, for example white-colored, covered wires and coloring the white-colored covered wires with required colors during assembling process of the wire harness. This process may have difficulty about a method of distinguishing covered wires.

The objects of this invention are to provide covered wires which can reduce costs of for example a wire harness assembled therewith and be easily distinguished, and a method of distinguishing covered wires which can reduce costs of the covered wires and easily distinguish the covered wires.

SUMMARY OF THE INVENTION

In order to overcome the above drawback and attain the objects, a covered wire according to claim 1 of this invention is specialized by that the covered wire having an electrical conductive core and a unicolor cover portion of synthetic resign for covering said core includes a first mark being formed by coloring a part of an outer surface of said cover portion with a first color, and a second mark being formed by coloring the other part of said outer surface of said cover portion with a second color different from said first color, wherein said first mark and said second mark are disposed alternately with a gap along lengthwise of said covered wire, and a length of said first mark along the lengthwise of said covered wire is longer than that of said second mark along the lengthwise of said covered wire.

According to this invention, the first mark and the second mark are disposed along lengthwise of the covered wire. Thereby, the widths of the first mark and the second mark along the circumference of the covered wire can be increased. The length of the first mark is longer than that of said second mark and the marks are disposed alternately with a gap. Therefore, the first mark and the second mark can be distinguished.

The first mark and the second mark are formed on the unicolor outer surface. Therefore, many various covered wires can be manufactured by properly selecting the first color and the second color for the pre-produced covered wire having a unicolor outer surface.

When one of the first color and the second color is the same color as the outer surface of the covered wire, the only other color of the first color and the second color different from the outer surface may be formed on the outer surface of the covered wire.

Coloring the outer surface of the cover portion described in this specification means coloring the outer surface of the cover portion of the covered wire with coloring material. The coloring material is liquid material dissolving and dispersing color material (industrial organic material) in solvent, such as water. There are dyestuffs and pigments (almost all thereof are organic and synthetic) as the organic material, and in case, some dyestuffs are used as pigments or some pigments are used as dyestuffs. Physically, the coloring material in this specification means the both of coloring liquid and paint.

The coloring liquid means what dissolves or disperses dyestuff in solvent. The paint means disperses pigment in fluid dispersion. By coloring the outer surface of the cover portion with the coloring liquid, the dyestuff penetrates into the cover portion. By coloring the outer surface of the cover portion with paint, the pigment adheres on the outer surface without penetrating into the cover portion. Thus, meaning of coloring the outer surface of the cover portion in this specification includes both of dying a part of the outer surface of the cover portion with dyestuff and painting a part of the outer surface of the cover portion with pigment.

The solvent and the liquid dispersion have preferably affinity to the synthetic resin used for the cover portion. Thereby, the dyestuff can penetrate securely into the cover portion or the pigment can adhere securely on the outer surface of the cover portion.

The covered wire of this invention is specialized by that one said first mark and one said second mark are disposed respectively at an end area of said covered wire.

According to this invention, each one of the first mark and the second mark is disposed at the end area of the covered wire. Thereby, volume of the coloring material to form the first mark and the second mark can be reduced. Additionally, when the covered wire moves by rollers for coloring, volume of the coloring material to be stuck on the rollers can be reduced.

The covered wire of this invention is specialized by further comprising means for distinguishing wire diameters as capable to distinguish outer diameters of said cover portions.

According to this invention, diameters of the covered wires are distinguished by the means for distinguishing wire diameters.

The covered wire of this invention is further specialized by that said means for distinguishing wire diameters is a plurality of marks provided with one of said first mark and said second mark divided to plural pieces, and disposed along the lengthwise of said covered wire.

According to this invention, the means for distinguishing wire diameters is provided with one of the first mark and the second mark divided to plural pieces. Thereby, diameters of the covered wires are distinguished by recognizing divided one of the first mark and the second mark.

A covered wire of this invention is specialized by that the covered wire having an electrical conductive core and a unicolor cover portion of synthetic resign for covering said core includes a plurality of third marks being formed by coloring a part of an outer surface of said cover portion with a third color, said third marks being disposed with a gap therebetween along lengthwise of said covered wire.

According to this invention, the third marks are disposed with a gap therebetween along lengthwise of said covered wire. Thereby, the third marks are easily distinguished from the cover portion so that the third marks are easily distinguished. Furthermore, the third marks are formed on the unicolor outer surface. Thereby, many various covered wires can be manufactured by selecting the third color properly for the pre-produced covered wire with a unicolor outer surface.

The covered wire of this invention is specialized by comprising means for distinguishing wire diameters as capable to ditinguing outer diameters of said cover portions.

According to this invention, the means for distinguishing wire diameters can distinguish wire diameters of covered wires.

The covered wire of this invention is further specialized by that said means for distinguishing wire diameters is a plurality of further marks or fourth marks provided with plural pieces thereof between a pair of said marks adjacent to each other by coloring a part of said outer surface of said cover portion with a further color or fourth color different from said color and disposed with a space along the lengthwise of said covered wire.

According to this invention, the means for distinguishing wire diameters is a plurality of fourth marks provided between the third marks. Furthermore, the fourth marks are disposed along the lengthwise of the covered wire, and the forth color is different from the third color. Thereby, the fourth marks are easily recognized so that the wire diameter of the covered wire can be distinguished by viewing the fourth marks.

A method of distinguishing covered wires of this invention is specialized by that the method has steps of forming a first mark by coloring a part of an outer surface of a unicolor covered wire with a first color and forming a second mark by coloring the other part of said outer surface with a second color different from the first color, wherein said first mark and said second mark are disposed alternately with a gap along lengthwise of said covered wire, and a length of said first mark along the lengthwise of said covered wire is longer than that of said second mark along the lengthwise of said covered wire, and colors for said first color and said second color are selected as capable to distinguish each covered wire. overed wire.

According to this invention, the first mark and the second mark are disposed with a gap along lengthwise of the covered wire. Thereby, the widths of the first mark and the second mark along the circumference of the covered wire can be increased. Therefore, the first mark and the second mark can be easily recognized. Furthermore, a length of the first mark is made longer than that of the second mark, and these marks are disposed with a gap therebetween. Therefore, the first mark and the second mark can be distinguished.

Therefore, the first color of the first mark and the second color of the second mark can be easily recognized, and the first color and the second color can be distinguished easily.

Furthermore, the first and second marks are formed on the unicolor outer surface of the covered wire. Thereby, many various covered wires can be manufactured by selecting the first and second colors properly for the pre-produced covered wire with a unicolor outer surface.

When one of the first color and the second color is the same color as the outer surface of the covered wire, the only other color of the first color and the second color different from the outer surface may be formed on the outer surface of the covered wire.

The method of distinguishing covered wires of this invention is further specialized by that one of said first mark and said second mark is divided to plural pieces as capable to distinguish outer diameters of said covered wires, and disposed along the lengthwise of said covered wire.

According to this invention, diameters of the covered wires can be distinguished by recognizing divided one of the first mark and the second mark.

A method of distinguishing covered wires of this invention is specialized by that the method includes a step of forming a plurality of third marks being formed by coloring a part of an outer surface of a unicolor covered wire with a third color, said third marks being disposed with a gap therebetween along lengthwise of said covered wire, wherein said third color is selected respectively for said covered wires as capable to distinguish each covered wire.

According to this invention, the third marks are disposed with a gap along lengthwise of the covered wire. Thereby, the widths of the third marks along the circumference of the covered wire can be increased. Therefore, the third marks can be easily recognized and then the third color of the third marks can be easily distinguished.

Furthermore, the third marks are formed on the unicolor outer surface of the covered wire. Thereby, many various covered wires can be manufactured by selecting the third color properly for the pre-produced covered wire with a unicolor outer surface.

The method of distinguishing covered wires of this invention is specialized by further comprising a step of forming a plurality of fourth marks between a pair of said third marks adjacent to each other by coloring the other part of said outer surface of said cover portion with a forth color different from said third color as capable to distinguish the outer diameters of said covered wires, the plurality of fourth marks being disposed along the lengthwise of said covered wire.

According to this invention, the outer diameter of the covered wire can be easily distinguished by recognizing existence of the plurality of fourth marks between the third marks. Furthermore, the fourth marks are disposed along the lengthwise of the covered wire. Thereby, the fourth marks can be easily recognized and then the diameters of the covered wires can be distinguished.

DESCRIPTION OF THE PREFERRED EMBODIMENT

Figure 1A:
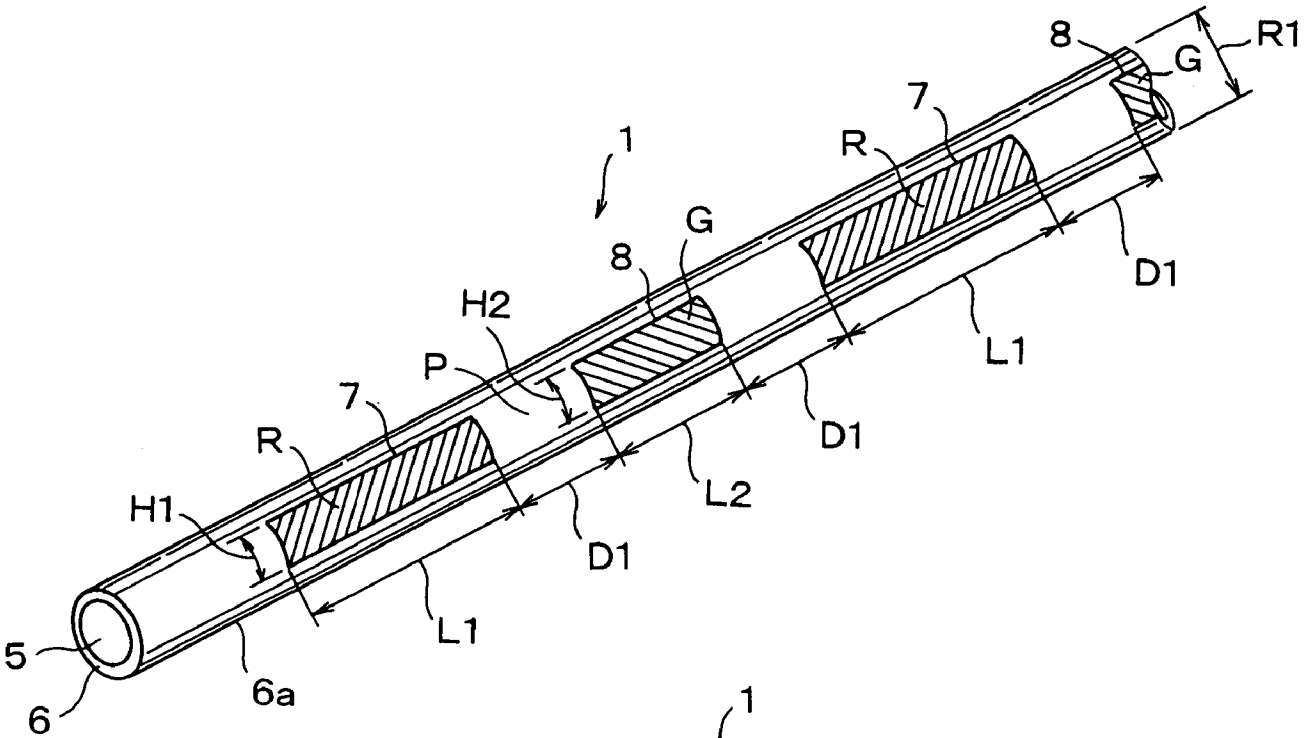
FIG. 1A is a perspective view of a first covered wire of an embodiment according to this invention.

An embodiment of a method of distinguishing covered wires according to this invention will be described with reference to FIG. 1A-10. The method of distinguishing covered wires is for distinguishing the first covered wire 1 shown in FIG. 1A, 1B, the second covered wire 2 shown in FIG. 2A, 2B, the third covered wire 3 shown in FIG. 7A, 7B and the fourth covered wire 4 shown in FIG. 8A, 8B. The first covered wire 1, the second covered wire 2, the third covered wire 3 and the fourth covered wire 4 correspond to covered wires described in this specification. The covered wires 1, 2, 3 and 4 form a wire harness wired in a car. The wire harness is formed with a plurality of covered wires 1, 2, 3 and 4 having different thickness (wire diameter or outer diameter) for example sectional area of 0.3 sq.mm, 0.5 sq.mm, 0.85 sq.mm and 1.25 sq.mm.

Figure 1B:
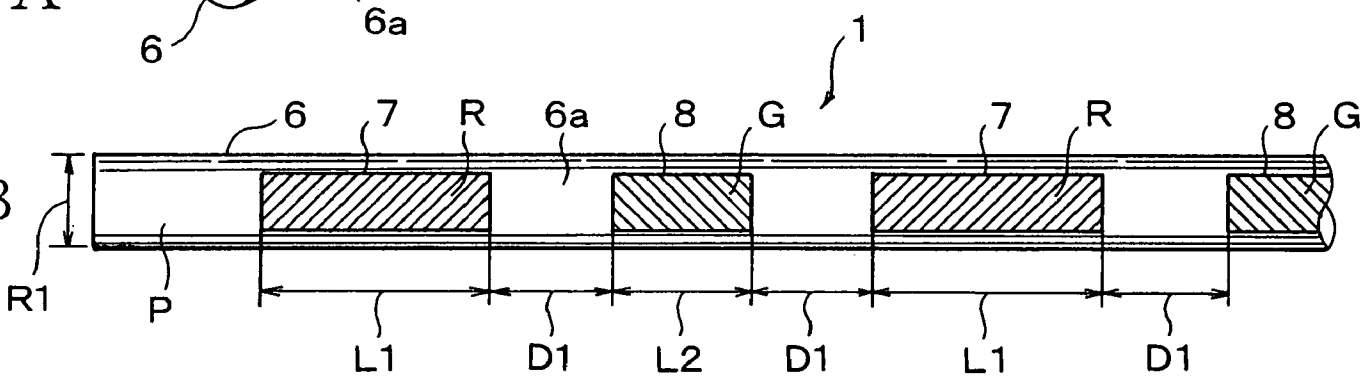
FIG. 1B is a side view of the first covered wire shown in FIG. 1A.

The first covered wire 1 has an electric conductive core 5 and an insulating cover portion 6 as shown in FIG. 1A and FIG. 1B. The core 5 is formed with a plurality of twisted element wires. The element wires forming the core 5 is made of electric conductive metal. The core 5 may be formed with a single element wire. The cover portion 6 may be made of synthetic resin such as polyvinylchloride (PVC). The cover portion 6 covers the core 5. An outer surface 6*a* of the cover portion 6 corresponds to an outer surface of the first covered wire 1.

Color of the outer surface 6*a* of the cover portion 6 is color P (one color, call unicolor hereafter). By adding a predetermined coloring material into the synthetic resin forming the cover portion 6, the outer surface 6*a* may be made in unicolor P. By adding no coloring material into the synthetic resin forming the cover portion 6, the own natural color of the synthetic resin may be unicolor P. When the unicolor P is natural color of the synthetic resin by adding no coloring material into the synthetic resin forming the cover portion 6, the outer surface 6*a* of the cover portion 6, i.e. the outer surface of the first covered wire 1 is called as uncolored.

Thus, uncolored means that the color of the outer surface 6*a* of the first covered wire 1 is the own natural color of the synthetic resin by adding no coloring material into the synthetic resin forming the cover portion 6. In this embodiment, by adding coloring material of white color into the synthetic resin forming the cover portion 6, the unicolor P of the outer surface 6*a* is white.

A first mark 7 and a second mark 8 are formed on a part of the outer surface 6*a* of the first covered wire 1. The first mark 7 and the second mark 8 are disposed alternatively with a gap to each other along lengthwise of the core 5 and the cover portion 6, i.e. the lengthwise of the first covered wire 1. The first mark 7 and the second mark 8 are formed on the outer surface 6*a* throughout the length of the first covered wire 1.

The first mark 7 extends in a straight line along lengthwise of the cover portion 6, i.e. the first covered wire 1. The first mark 7 is colored in the first color R (shown by hatching in FIG. 1A, 1B). Then, the first mark 7 is formed by means of coloring a part of the outer surface 6*a* with the first color R. The first color R may be different from the unicolor P or may be the same as the unicolor P.

The second mark 8 extends in a straight line along lengthwise of the cover portion 6, i.e. the first covered wire. 1. The second mark 8 is colored in the second color G (shown by hatching in FIG. 1A, 1B). The second color G is different from the first color R. Then, the second mark 8 is formed by coloring a part of the outer surface 6*a* with the second color G. The second color R may be different from the unicolor P or may be the same as the unicolor P.

A length L1 of the first mark 7 along lengthwise of the core 5 and the cover portion 6, i.e. along lengthwise of the first covered wire 1 is predetermined. A space D1 between the first mark 7 and the second mark 8 adjacent to each other along lengthwise of the core 5 and the cover portion 6, i.e. along lengthwise of the first covered wire 1 is predetermined. A length L2 of the second mark 8 along lengthwise of the core 5 and the cover portion 6, i.e. along lengthwise of the first covered wire 1 is predetermined. The length L1 is longer than the length L2.

Figure 3A:
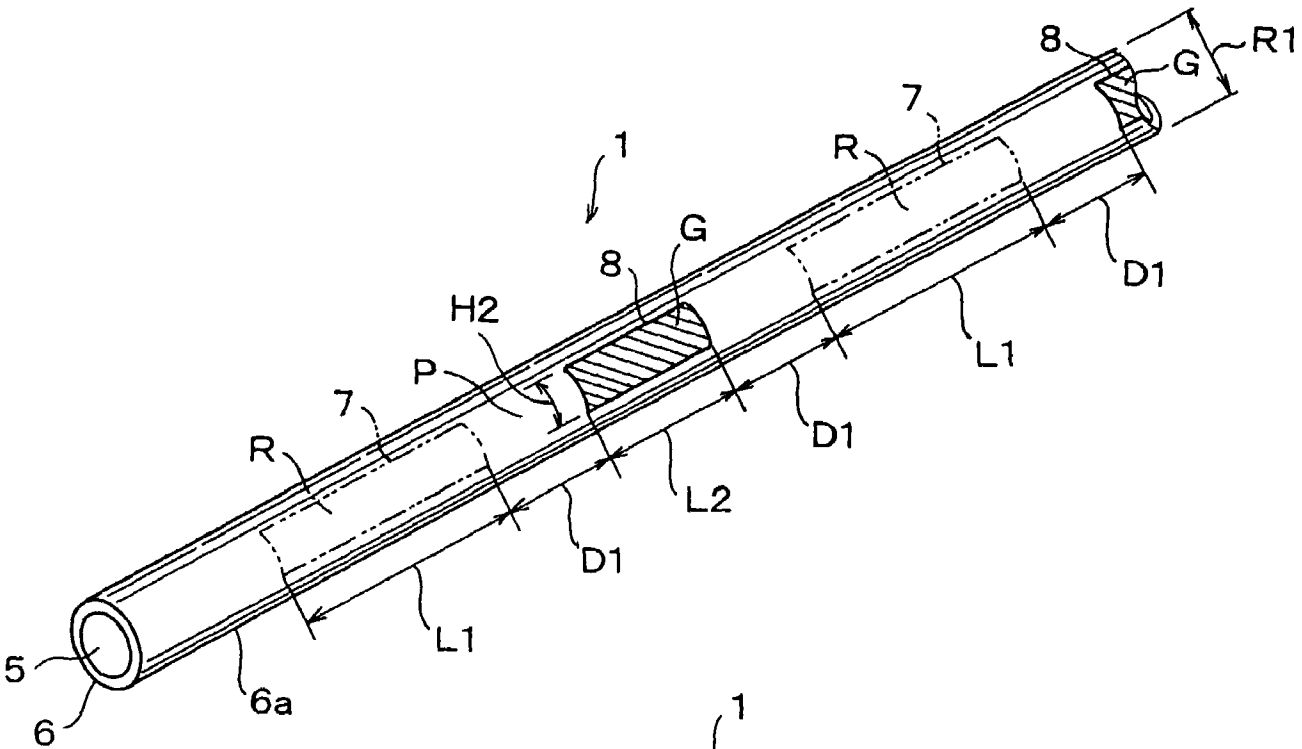
FIG. 3A is a perspective view of a modified example of the first covered wire shown in FIG. 1A.
Figure 5A:
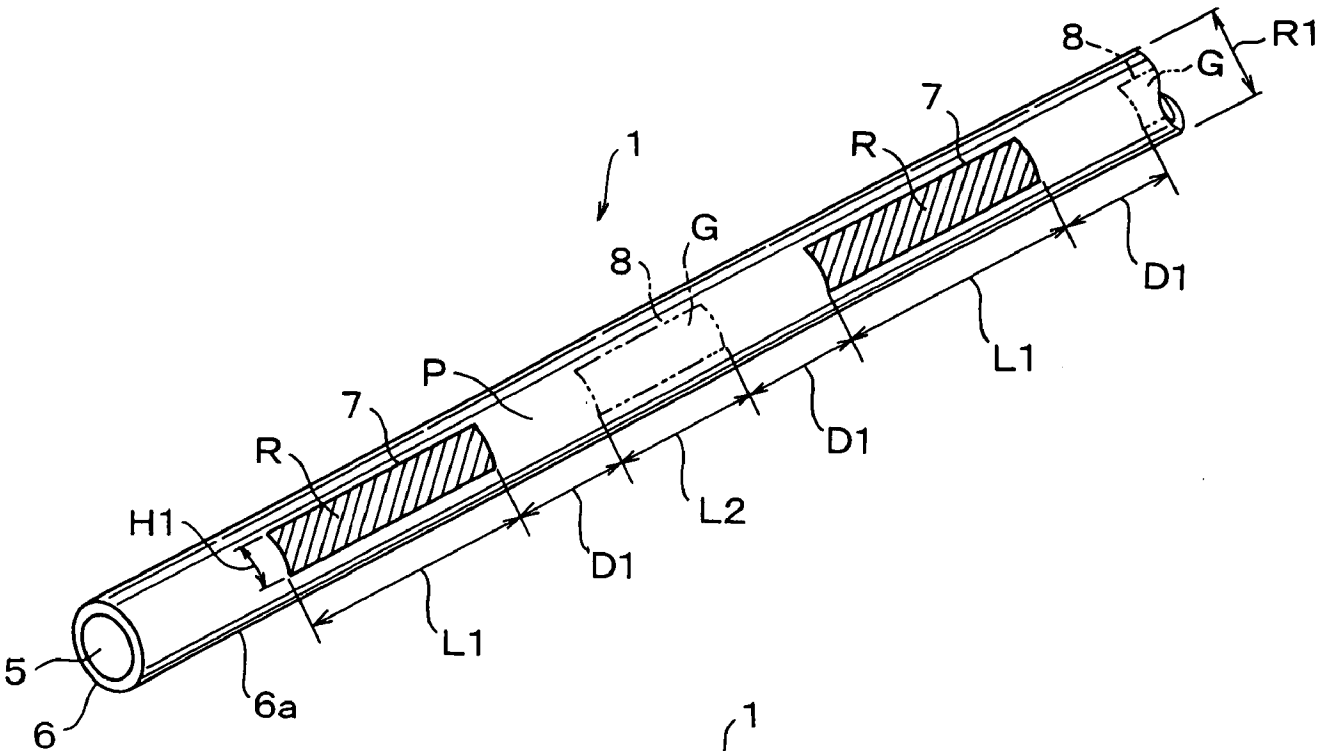
FIG. 5A is a perspective view of the other modified example of the first covered wire shown in FIG. 1A.

The first color R and the second color G of the aforesaid first covered wire 1 are changed properly. By changing the first color R and the second color G of the aforesaid first covered wire 1 properly, the first covered wires 1 can be distinguished from each other. For example, the first covered wire 1 of a wire harness wired in a car may be indicated about the aforesaid systems by combinations of the first color Rand the second color G. The combinations of the first color R and the second color G may be corresponded to combinations of colors A and B of the aforesaid prior covered wires In case, one of the first color R and the second color G of the aforesaid first covered wire 1 may be the same color as the unicolor P of the outer surface 6*a* as shown in FIG. 3A and 5A. In this case, only one of marks 7 and 8 by the other color of the first color R and the second color G different from the unicolor P of the outer surface 6*a* can be formed. Or the both of the first mark 7 and the second mark 8 may be formed also. In this case, it seems that the only one of marks 7 and 8 by the other color of the first color R and the second color G different from the unicolor P of the outer surface 6*a* is formed.

Figure 3B:
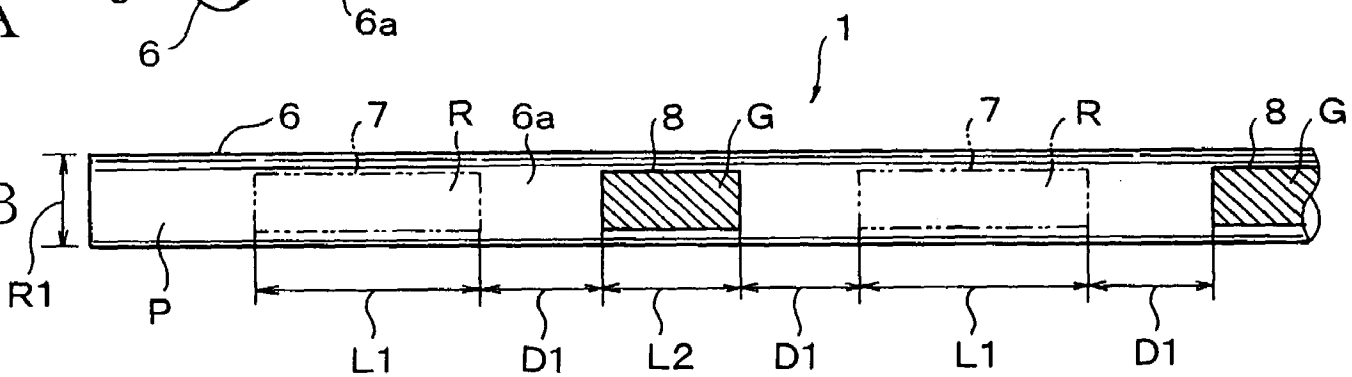
FIG. 3B is a side view of the modified example of the first covered wire shown in FIG. 3A.

In FIG. 3A, 3B, the first color R is the same as the unicolor P and it seems that only the second mark 8 is formed. Areas to form the first mark 7 shown with long dashed double-short dashed line in FIG. 3A, 3B have no marks and color of the areas is unicolor P or the first color R same as the unicolor P. In FIG. 3A, 3B, only the second marks 8 are formed at the areas where the second marks 8 are formed in FIG. 1A, 1B. The first covered wire 1 in FIG. 3A, 3B can be distinguished by combination of the unicolor P, i.e. the first color R, and the second color G.

Figure 5B:
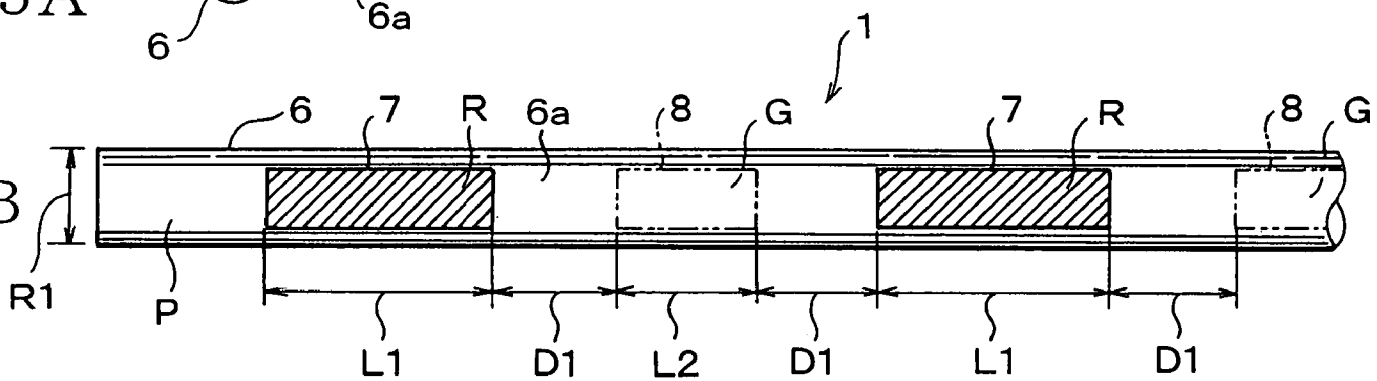
FIG. 5B is a side view of the other modified example of the first covered wire shown in FIG. 5A.

In FIG. 5A, 5B, the second color G is the same as the unicolor P so that it seems that only the first marks 7 are formed. Areas to form the first mark 8 shown with long dashed double-short dashed line in FIG. 5A, 5B have no marks and color of the areas is unicolor P or the second color G same as the unicolor P. In FIG. 5A, 5B, only the first marks 7 are formed at the areas where the first marks 7 are formed in FIG. 1. The first covered wire 1 in FIG. 5A, 5B can be distinguished by combination of the first color R of the first mark 7, and the unicolor P, i.e. the second color G.

Figure 2A:
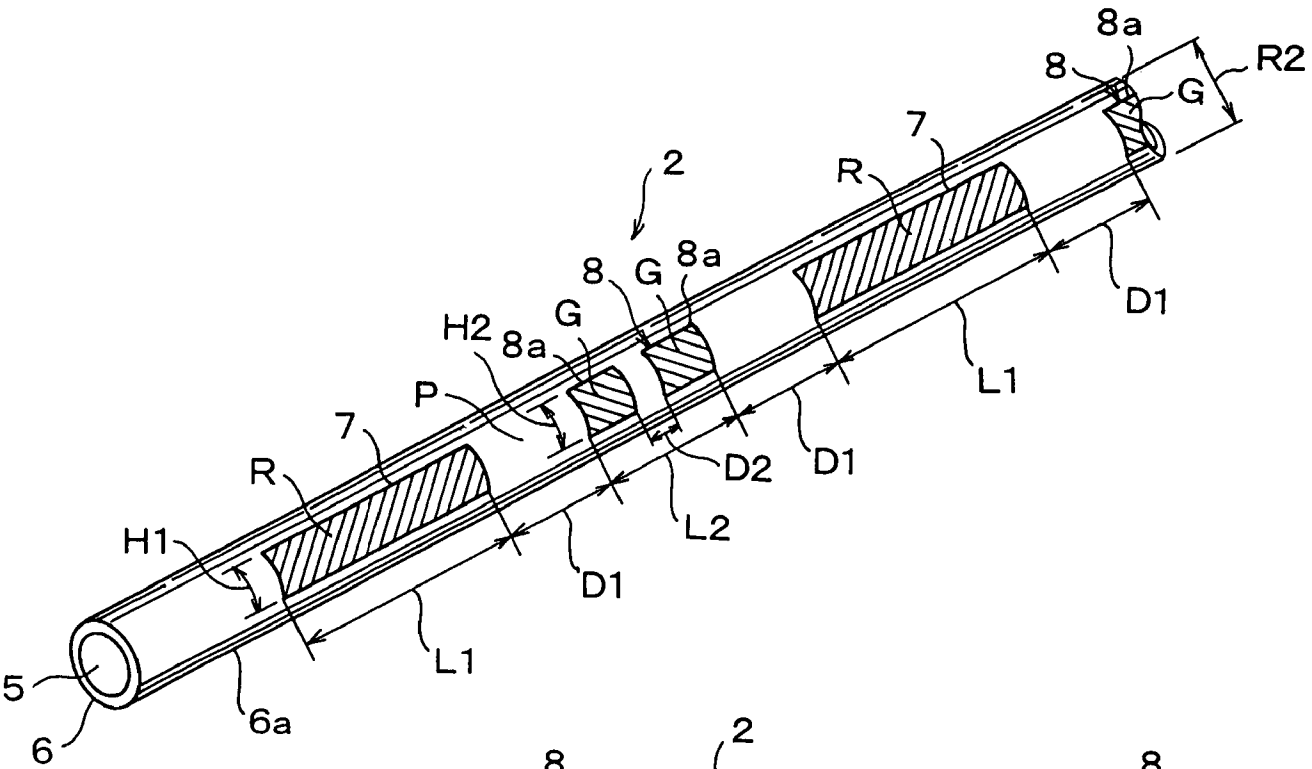
FIG. 2A is a perspective view of a second covered wire of an embodiment according to this invention.
Figure 2B:
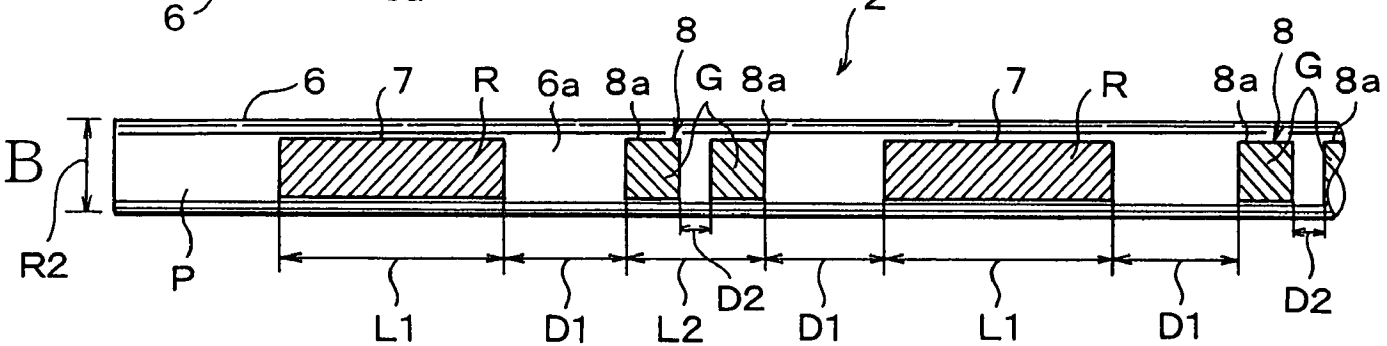
FIG. 2B is a side view of the second covered wire shown in FIG. 2A.

The second covered wire 2 shown in FIG. 2A, 2B has the almost same structure as the first covered wire 1. Therefore, the same portions of the second covered wire 2 as the first covered wire 1 are marked with the same mark and explanations regarding them are omitted. The first mark 7 and the second mark 8 are formed at a part of an outer surface 6*a* of the second covered wire 2 similarly as the aforesaid first covered wire 1, as shown in FIGS. 2A and 2B. The first mark 7 is formed by means of coloring the part of the outer surface 6*a* with the first color R. The second mark 8 is formed by means of coloring the part of the outer surface 6*a* with the second color G.

The second mark 8 of the second covered wire 2 is divided into two. The two marks-formed by dividing the second mark 8 are respectively shown by mark 8*a*. These marks 8*a* are disposed with a gap therebetween along lengthwise of the cover portion 6; i.e. lengthwise of the second covered wire 2. A space D2 between the marks 8*a* is predetermined.

The second covered wire 2 can be distinguished by combination of the first color R and the second color G. The aforesaid systems are shown by combinations of the first color R and the second color G of a wire harness wired in a car.

An outer diameter R2 (shown in FIG. 2A, 2B and called "wire diameter" hereafter) of the second covered wire 2 is different from an outer diameter R1 (shown in FIG. 1A, 1B and called "wire diameter" hereafter) of the first covered wire 1. When the first and second colors R, G of the second covered wire 2 are the same as the first and second colors R, G of the first covered wire 1, the first and second covered wires 1, 2 can be distinguished by dividing the aforesaid mark 8 into two.

Thus, the second mark 8 divided into two is formed on the second covered wire 2 having predetermined wire diameter. The second mark 8 divided into two enables to distinguish the first covered wire land the second covered wire 2, i.e. wire diameters R1, R2 of the first and second covered wires 1, 2. In other words, the second mark 8 divided into two enables to distinguish whether or not the covered wire has the predetermined wire diameter. Then, the wire diameters R1, R2 of the covered wires 1, 2 can be distinguished by checking whether or not the second mark 8 is divided. Therefore, the marks 8*a* formed by dividing the second mark 8 into two perform as the means of distinguishing wire diameters described in this specification. The wire diameters R1, R2 correspond to the outer diameters of the cover portions 6.

Figure 4A:
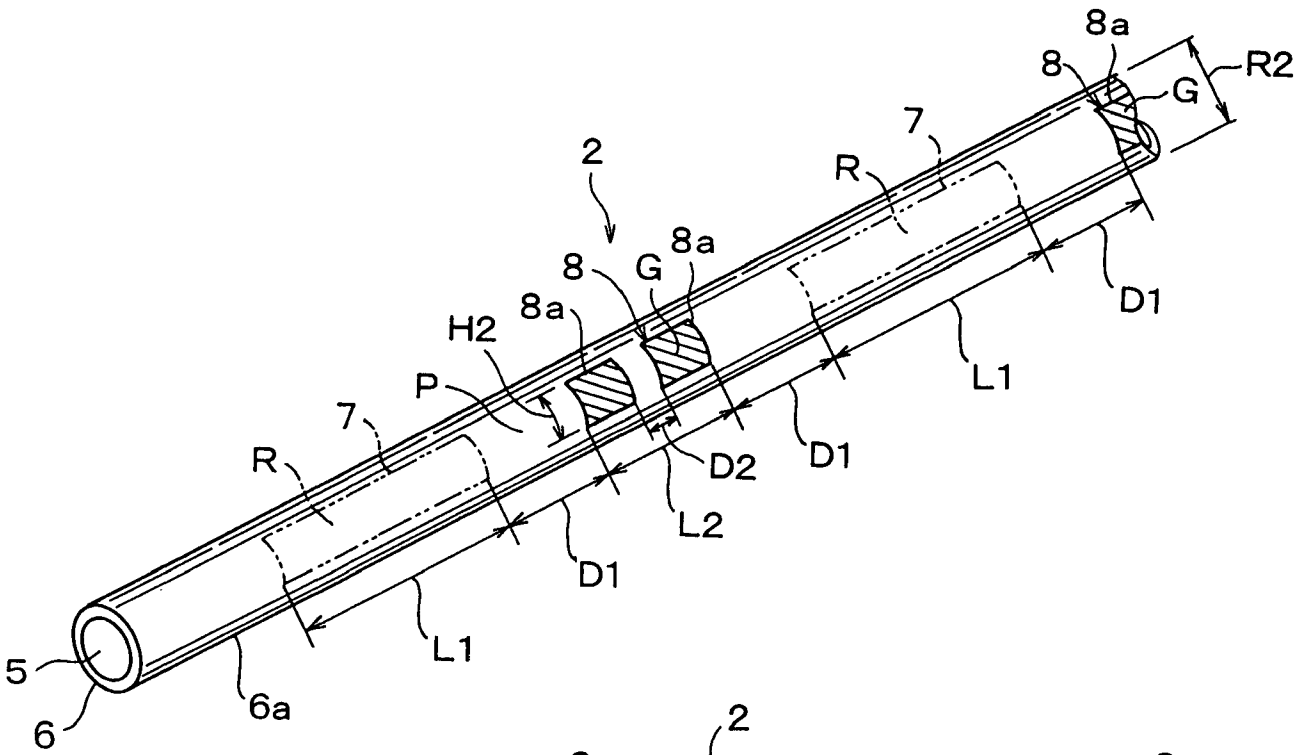
FIG. 4A is a perspective view of a modified example of the second covered wire shown in FIG. 2A.
Figure 6A:
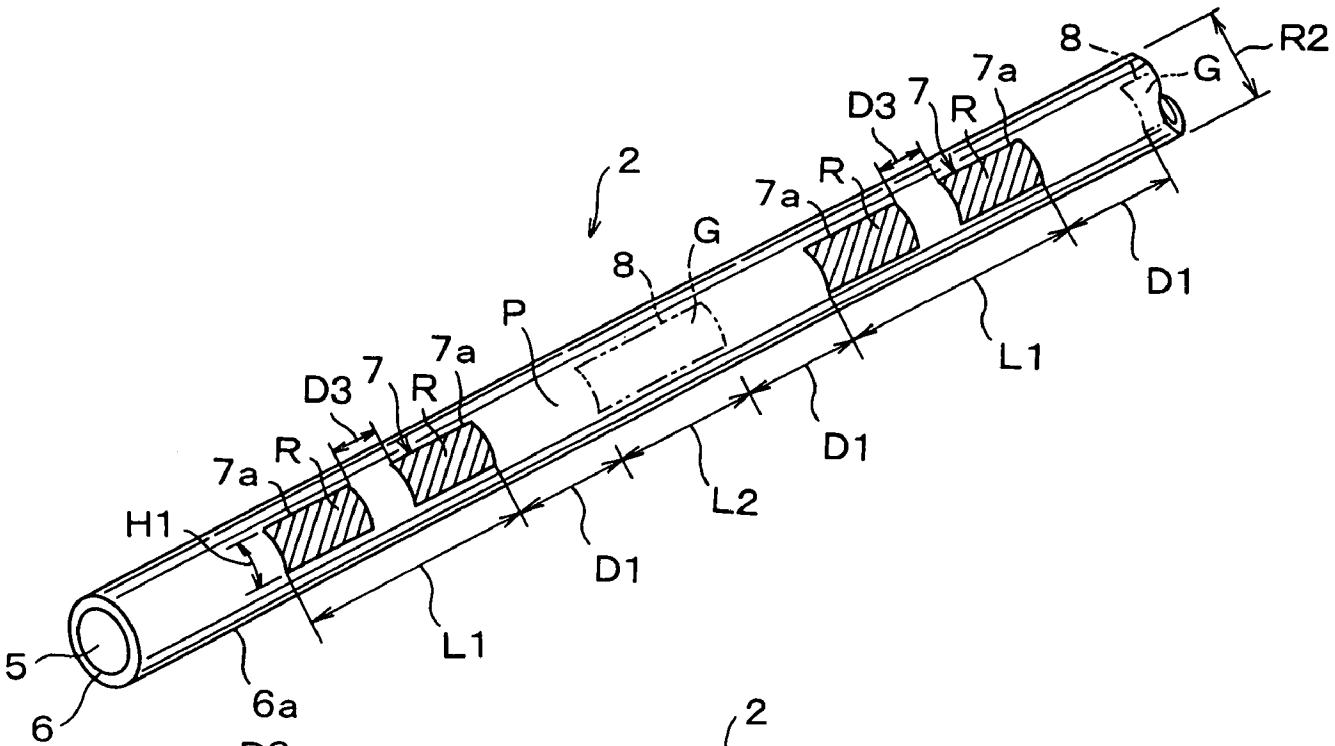
FIG. 6A is a perspective view of the other modified example of the second covered wire shown in FIG. 2A.

In case, one of the first color R and the second color G of the aforesaid second covered wire 2 may be the same color as the unicolor P of the outer surface 6*a* as shown in FIGS. 4A and 6A. In this case, only one of marks 7 and 8 by the other color of the first color R and the second color G different from the unicolor P of the outer surface 6*a* can be formed. Or the both of the first mark 7 and the second mark 8 may be formed also. In this case, it seems that the only one of marks 7 and 8 by the other color of the first color R and the second color G different from the unicolor P of the outer surface 6*a* is formed.

Figure 4B:
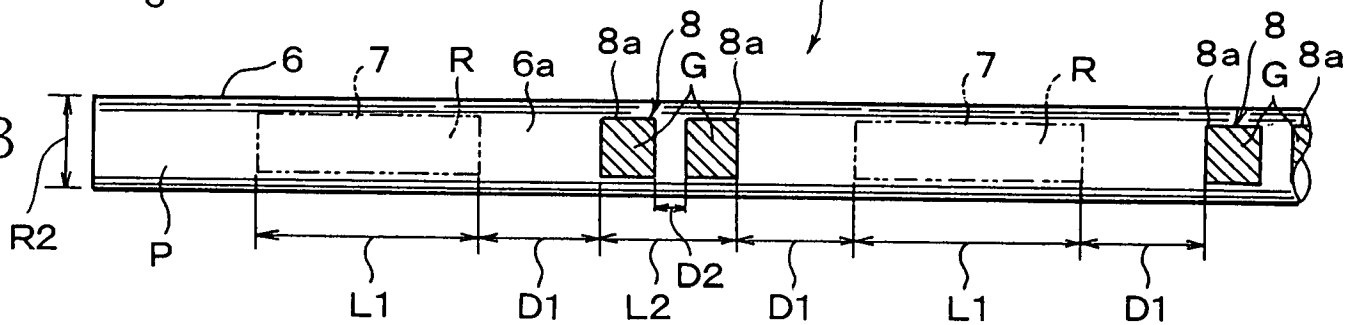
FIG. 4B is a side view of the modified example of the second covered wire shown in FIG. 4A.

In FIG. 4A, 4B, the first color R is the same as the unicolor P and it seems that only the second mark 8 is formed. Areas to form the first mark 7 shown with long dashed double-short dashed line in FIG. 4A, 4B have no marks and color of the areas is unicolor P or the first color R same as the unicolor P.

In FIG. 4A, 4B, only the second marks 8 are formed at the areas where the second marks 8 are formed in FIG. 2A, 2B. The second covered wires 2 in FIG. 4A, 4B can be distinguished by combination of the unicolor P, i.e. the first color R, and the second color G of the second mark 8. Furthermore, the wire diameters R1, R2 of the covered wires 1, 2 can be distinguished by checking whether or not the second mark 8 is divided.

Figure 6B:
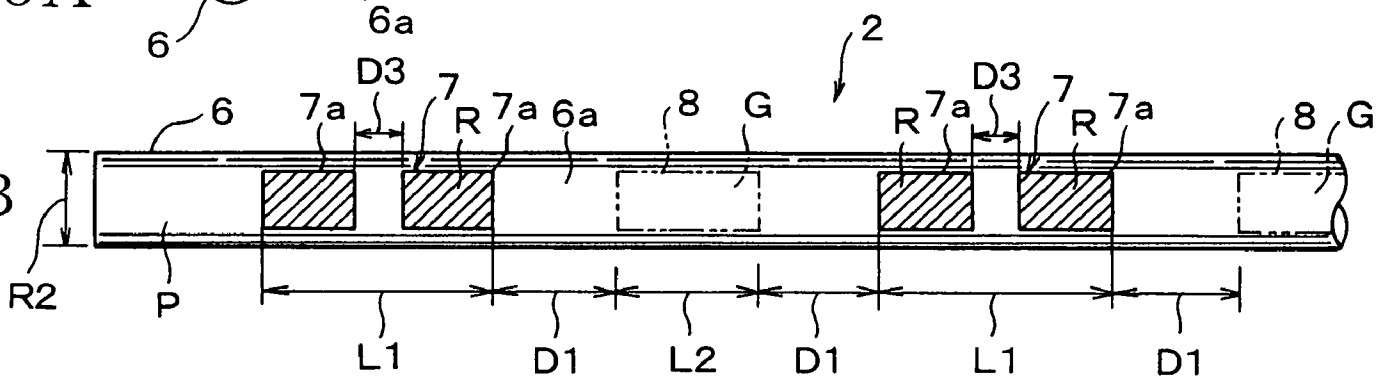
FIG. 6B is a side view of the other modified example of the second covered wire shown in FIG. 6A.

In FIG. 6A, 6B, the second color G is the same as the unicolor P so that it seems that only the first marks 7 are formed. Areas to form the first mark 8 shown with long dashed double-short dashed line in FIG. 5A, 5B have no marks and color of the areas is unicolor P or the second color G same as the unicolor P. In FIG. 6A, 6B, only the first marks 7 are formed at the areas where the first marks 7 are formed in FIG. 1.

When the second color G of the second mark 8 is the same as the unicolor P, the first mark 7 is divided into two. The two marks formed by dividing the first mark 7 are respectively shown by mark 7*a*. These marks 7*a* are disposed with a gap therebetween along lengthwise of the cover portion 6, i.e. lengthwise of the second covered wire 2, and perform as the means of distinguishing wire diameters described in this specification.

A space D3 between the marks 7*a* is predetermined. The second covered wire 2 in FIG. 6A, 6B can be distinguished by combination of the unicolor P, i.e. the first color R, and the second color G. In FIG. 6A, 6B, the wire diameters R1, R2 of the covered wires 1, 2 can be distinguished by checking whether or not the first mark 7 is divided. Thus, the marks 7*a* and the marks 8*a* as the means of distinguishing wire diameters to be formed on the second covered wire 2 having predetermined wire diameter enable to distinguish the second covered wire 2 from the covered wires having the other wire diameters.

Figure 7A:
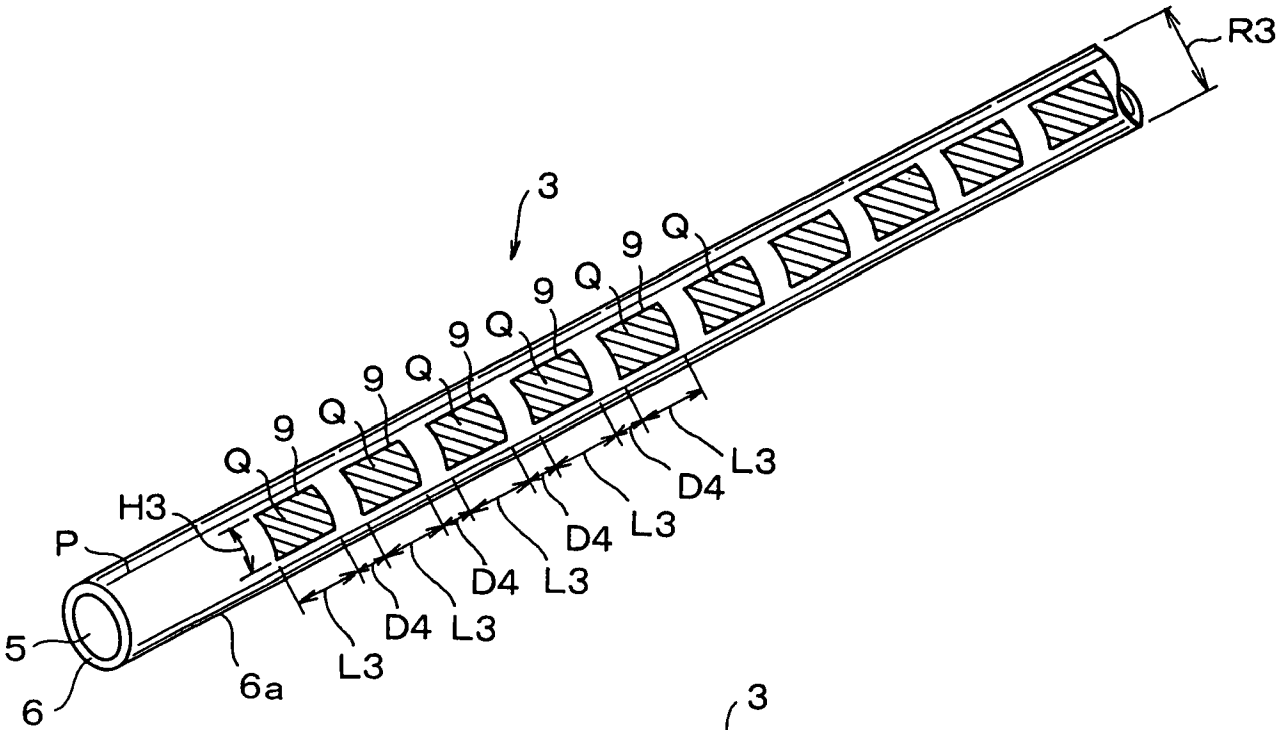
FIG. 7A is a perspective view of a third covered wire of an embodiment according to this invention.
Figure 7B:
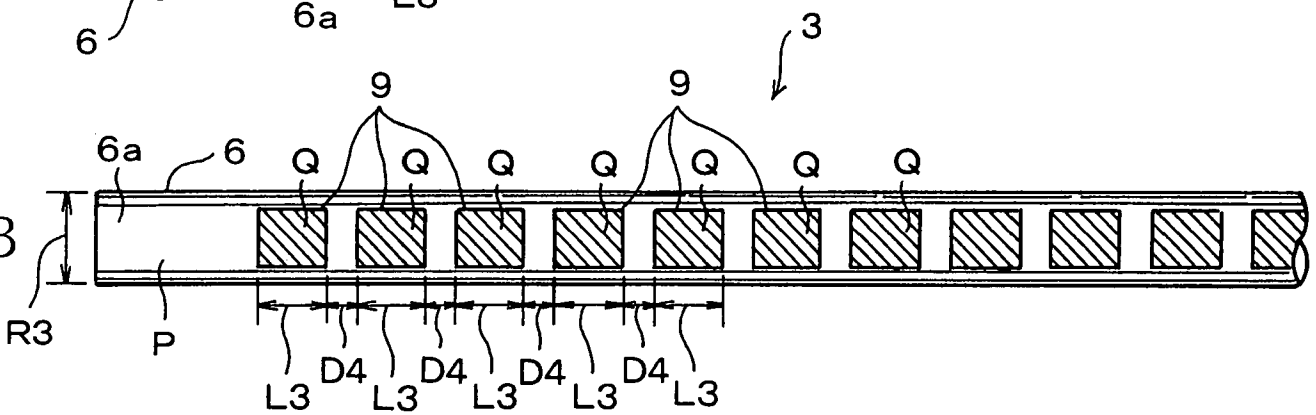
FIG. 7B is a side view of the third covered wire shown in FIG. 7A.

The third covered wire 3 shown in FIG. 7A, 7B has the almost same structure as the first covered wire 1 and the second covered wire 2. Therefore, the same portions of the third covered wire 3 as the covered wires 1, 2 are marked with the same mark and explanations regarding them are omitted. A plurality of the third marks 9 are formed at a part of an outer surface 6*a* of the third covered wire 3 as shown in FIGS. 7A and 7B.

The third marks 9 are disposed along lengthwise of the core 5 and the cover portion 6, i.e. the lengthwise of the third covered wire 3. The respectively adjacent third marks 9 are disposed with a gap. The third marks 9 are formed on the outer surface 6*a* throughout the length of the third covered wire 3. A space D4 between the respectively adjacent third marks 9 is predetermined. A length L3 of the third mark 9 along lengthwise of the core 5 and the cover portion 6, i.e. along lengthwise of the third covered wire 3, is predetermined.

The third mark 9 is formed by coloring at a part of the outer surface 6*a* with the third color Q (shown by hatching in FIG. 7A, 7B). The third color Q is different from the unicolor P. The third color Q may be different from the first color R or may be the same as the first color R. The third color Q may be different from the first color R or may be the same as the first color R. The third marks 9 are disposed preferably at the same intervals along lengthwise of the cover portion 6, i.e. the lengthwise of the third covered wire 3.

The third color Q of the aforesaid third covered wire 3 is changed properly. By changing the third color Q of the aforesaid third covered wire 3 properly, the third covered wires 3 can be distinguished from each other. The third marks 9 colored with the same third color Q are disposed with a gap to each other along lengthwise of the core 5 and the cover portion 6, i.e. the lengthwise of the third covered wire 3, so that the third covered wire 3 can be distinguished against the first and second covered wires 1, 2.

For example, the third covered wire 3 may be shown as the aforesaid system by the third color Q in the wire harness wired in the car. Preferably, the third color Q may correspond to the color of the outer surface of the unicolor covered wire which has been used.

Figure 8A:
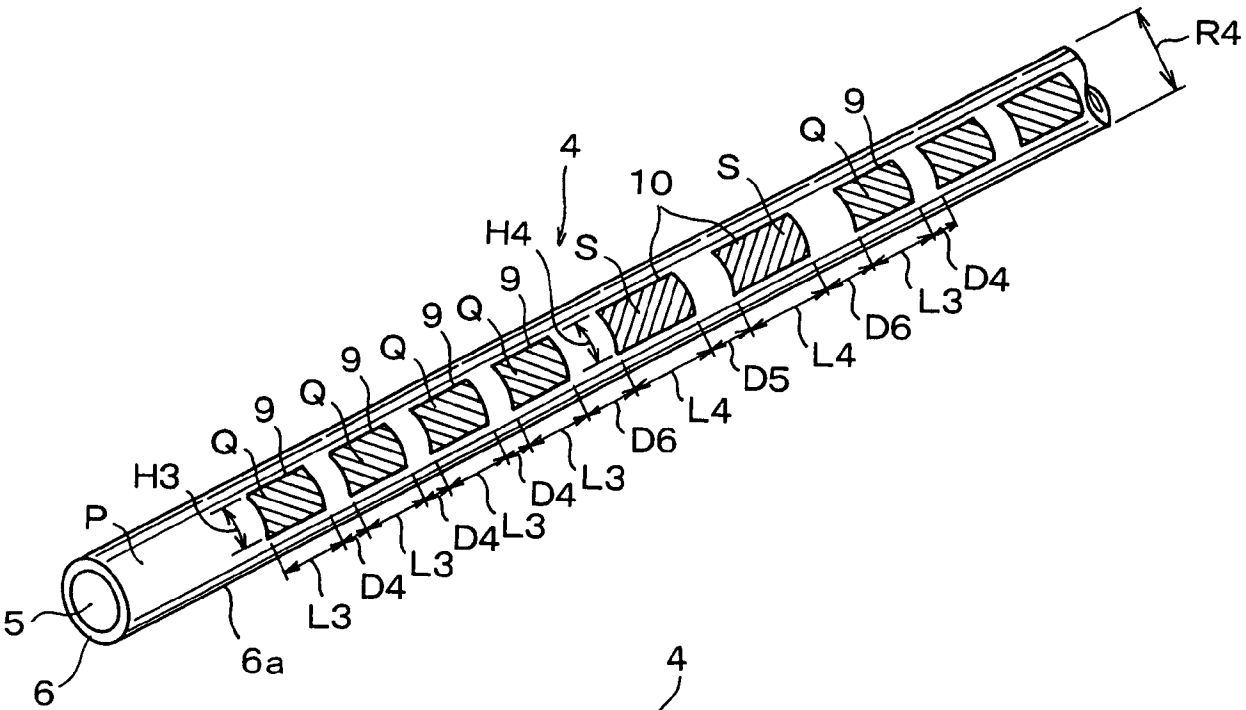
FIG. 8A is a perspective view of a fourth covered wire of an embodiment according to this invention.
Figure 8B:
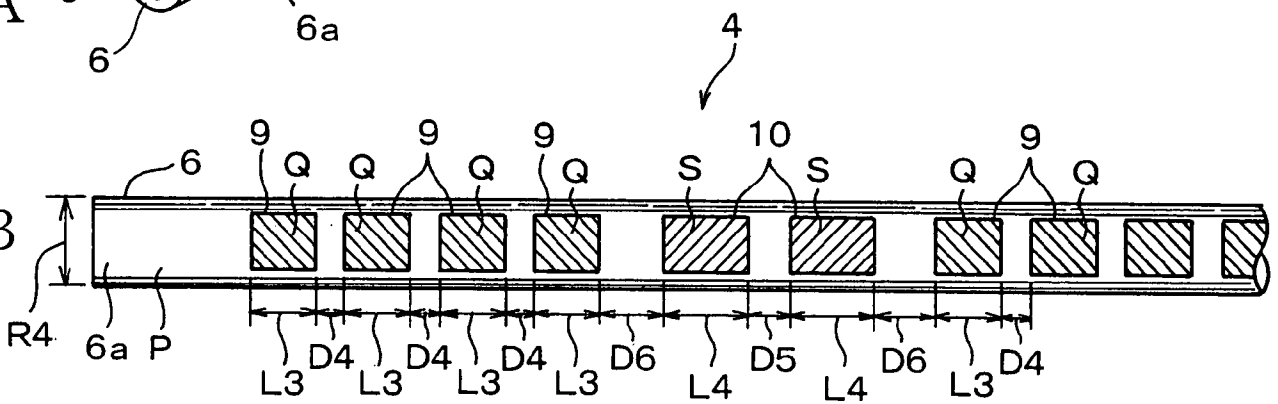
FIG. 8B is a side view of the fourth covered wire shown in FIG. 8A.

The fourth covered wire 4 shown in FIG. 8A, 8B has the almost same structure as the third covered wire 3. Therefore, the same portions of the fourth covered wire 4 as the third covered wire 3 are marked with the same mark and explanations regarding them are omitted. A plurality of the third marks 9 are formed at a part of an outer surface 6*a* of the fourth covered wire 4 similarly as the third covered wire 3, as shown in FIGS. 8A and 8B. A plurality of the fourth marks 10 is additionally formed at a part of an outer surface 6*a* of the fourth covered wire 4. In FIG. 8A, 8B, two fourth marks 10 are formed.

The plurality of the fourth marks 10 is formed between a pair of the third marks 9 adjacent to each other. The plurality of the fourth marks 10 is disposed along lengthwise of the core 5 and the cover portion 6, i.e. the lengthwise of the fourth covered wire 4. The plurality of the fourth marks 10 is formed with a gap to each other. The fourth marks 10 are disposed to have a gap against the third marks 9 along lengthwise of the core 5 and the cover portion 6, i.e. the lengthwise of the fourth covered wire 4.

A space D5 between the respectively adjacent fourth mark 10 is predetermined. A space D6 between the fourth mark 10 and the third mark 9 adjacent to each other is predetermined. A length L4 of the fourth mark 10 along lengthwise of the cover portion 6, i.e. along lengthwise of the fourth covered wire 4 is predetermined.

The fourth mark 10 is formed by coloring at a part of the outer surface 6*a* with the fourth color S (shown by hatching in FIG. 8A, 8B). The fourth color S is different from both the unicolor P and the third color Q. The fourth color S may be different from the first color R or may be the same as the first color R. The fourth color S may be different from the first color R or may be the same as the first color R.

The third color Q of the aforesaid fourth covered wire 4 is changed properly. By changing the third color Q of the aforesaid fourth covered wire 4 properly, the fourth covered wires 4 can be distinguished from each other. The third marks 9 colored with the same third color Q are disposed with a gap to each other along lengthwise of the cover portion 6, i.e. the lengthwise of the fourth covered wire 4, so that the fourth covered wire 4 can be distinguished against the first and second covered wires 1, 2.

For example, the fourth covered wire 4 may be shown as the aforesaid system by the third color Q in the wire harness wired in the car. Preferably, the third color Q may correspond to the color of the outer surface of the unicolor covered wire which has been used.

An outer diameter R4 (shown in FIG. 8A, 8B, and called "wire diameter" hereafter) of the fourth covered wire 4 is different from an outer diameter R3 (shown in FIG. 7A, 7B, and called "wire diameter" hereafter) of the third covered wire 3. When the third color Q of the fourth covered wire 4 are the same as the third color Q of the third covered wire 3, the third and fourth covered wires 3, 4 can be distinguished by disposing the aforesaid mark 10 on the fourth covered wire 4.

Thus, the fourth mark 10 is formed on the fourth covered wire 4 having predetermined wire diameter. The fourth mark 10 enables to distinguish the third covered wire 3 and the fourth covered wire 3, i.e. wire diameters R3, R4 of the third and fourth covered wires 3, 4. In other words, the fourth mark 10 enables to distinguish whether or not the covered wire has predetermined wire diameter. Then, the wire diameters R3, R4 of the covered wires 3, 4 can be distinguished by checking whether or not the fourth mark 10 exists. Therefore, the fourth marks 10 perform as the means of distinguishing wire diameters described in this specification. The fourth mark 10 as the means for distinguishing wire diameters to be formed on the fourth covered wire 4 having the predetermined diameter. The wire diameters R3, R4 correspond to the outer diameters of the cover portions 6.

The first covered wire 1, the second covered wire 2, the third covered wire 3 and the fourth covered wire 4 mentioned above structure a wire harness. The wire harness includes a plurality of the first covered wires 1, a plurality of the second covered wires 2, a plurality of the third covered wires 3, a plurality of the fourth covered wires 4 and a connector joined with ends of these covered wires 1, 2, 3 and 4.

The wire harness is assembled by banding the covered wires 1, 2, 3 and 4, and joining the connector with the covered wires 1, 2, 3 and 4. The assembled wire harness is wired in a car so as to connect the connector with a mating connector of an electronic device. The wire harness supplies electric power and signals to the electronic device.

The colors R, G, Q, S of the aforesaid marks 7, 8, 9, 10 are used for distinguishing wire types of the covered wires 1, 2, 3, 4 of the wire harness wired in the car and a car system in which the covered wires 1, 2, 3, 4 are used. In other words, the colors R, G, Q, S of the aforesaid marks 7, 8, 9, 10 show purposes of use of respective covered wires 1, 2, 3, 4 of the wire harness and enable for distinguishing the purposes of use. The covered wires 1, 2, 3, 4 are marked (colored) at the outer surfaces 6*a* with a liquid coloring material for distinguishing wire types and the systems, i.e. the purposes of use.

Figure 9:
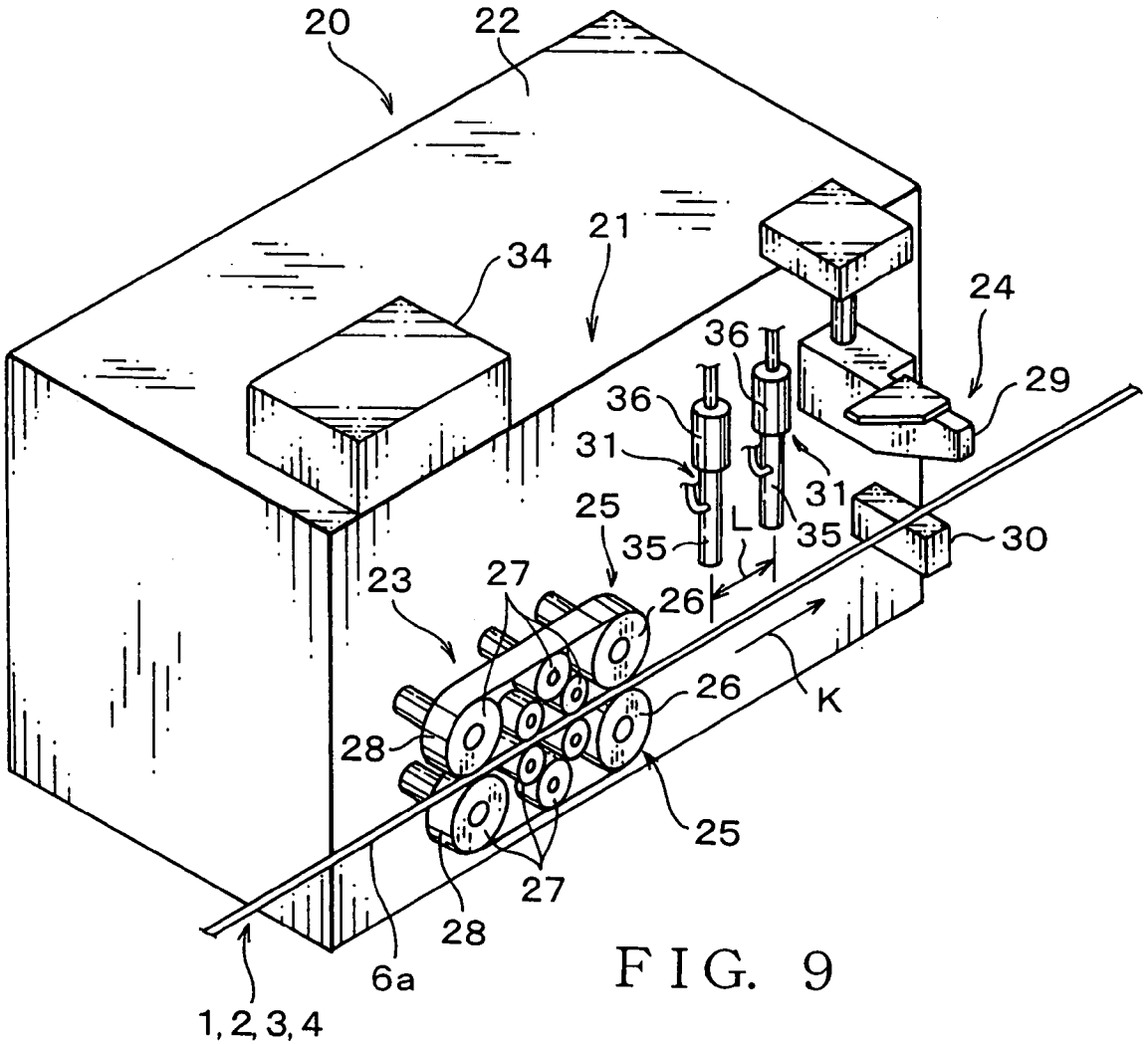
FIG. 9 is a perspective view, showing a structure of a wire cutting apparatus mounting a marking machine for forming the marks on the covered wires as shown in FIG. 1A-8A.

To form the first mark 7, the second mark 8, the third mark 9 and the fourth mark 10 on the outer surfaces 6*a* of the cover portions of the first covered wire 1, the second covered wire 2, the third covered wire 3 and the fourth covered wire 4, a marking machine 21 shown in FIG. 9 is used. The marking machine 21 is mounted on a wire cutting apparatus 20 as shown in FIG. 9.

The wire cutting apparatus 20 includes a main body 22 to be mounted on a floor of a factory, a measuring device 23 and a cutting device 24. The main body 22 is formed into box shape. The measuring device 23 has a pair-of belt-conveying units 25.

The belt-conveying unit 25 has a drive pulley 26, a plurality of driven pulleys 27 and an endless belt 28. The drive pulley 26 is rotationally driven with a motor as a driving source mounted in the main body 22. The driven pulleys 27 are supported rotatably on the main body 22. The endless belt 28 is a ring-shape (endless) belt to be engaged with the drive pulley 26 and the driven pulleys 27. The endless belt 28 rotates around the pulleys 26, 27.

The pair of belt-conveying units 25 is disposed vertically. The pair of belt-conveying units 25 clamps the first, second, third and fourth covered wires 1; 2, 3, 4 therebetween and conveys predetermined length of the first, second, third and fourth covered wires 1, 2, 3, 4 by the endless belts 28 rotated by rotating synchronously the drive pulleys 26.

The pair of belt-conveying units 25 conveys the first, second, third and fourth covered wires 1, 2, 3, 4 along an arrow K in FIG. 9 parallel to lengthwise of the first, second, third and fourth covered wires 1, 2, 3, 4. The arrow K corresponds to one direction described in this specification along the horizontal direction.

The cutting device 24 is disposed at downstream side of the arrow K from the pair of belt-conveying units 25. The cutting device 24 has a pair of cutting blades 29, 30. The pair of cutting blades 29, 30 is disposed along the vertical direction. The pair of cutting blades 29, 30 moves close to each other and apart from each other along the vertical direction. The pair of cutting blades 29, 30 clamps the first, second, third and fourth covered wires 1, 2, 3, 4 conveyed by the pair of belt-conveying units 25 therebetween and cuts them by moving close to each other. The pair of cutting blades 29, 30 moves apart from the first, second, third and fourth covered wires 1, 2, 3, 4 by moving apart from each other.

The wire cutting apparatus 20 having above structure clamps the first, second, third and fourth covered wires 1, 2, 3, 4 between the pair of belt-conveying units 25 in a condition of keeping the pair of the cutting blades 29, 30 of the cutting device 24 apart from each other, and conveys the first, second, third and fourth covered wires 1, 2, 3, 4 along the arrow K. After the predetermined length of the first, second, third and fourth covered wires 1, 2, 3, 4 are conveyed, the drive pulleys 26 of the pair of belt-conveying units 25 are stopped. Thereafter, the pair of the cutting blades 29, 30 moves close to each other and clamps the first, second, third and fourth covered wires 1, 2, 3, 4 therebetween and cuts them. Thus, the wire cutting apparatus 20 moves the first, second, third and fourth covered wires 1, 2, 3, 4 along the arrow K.

Figure 10:
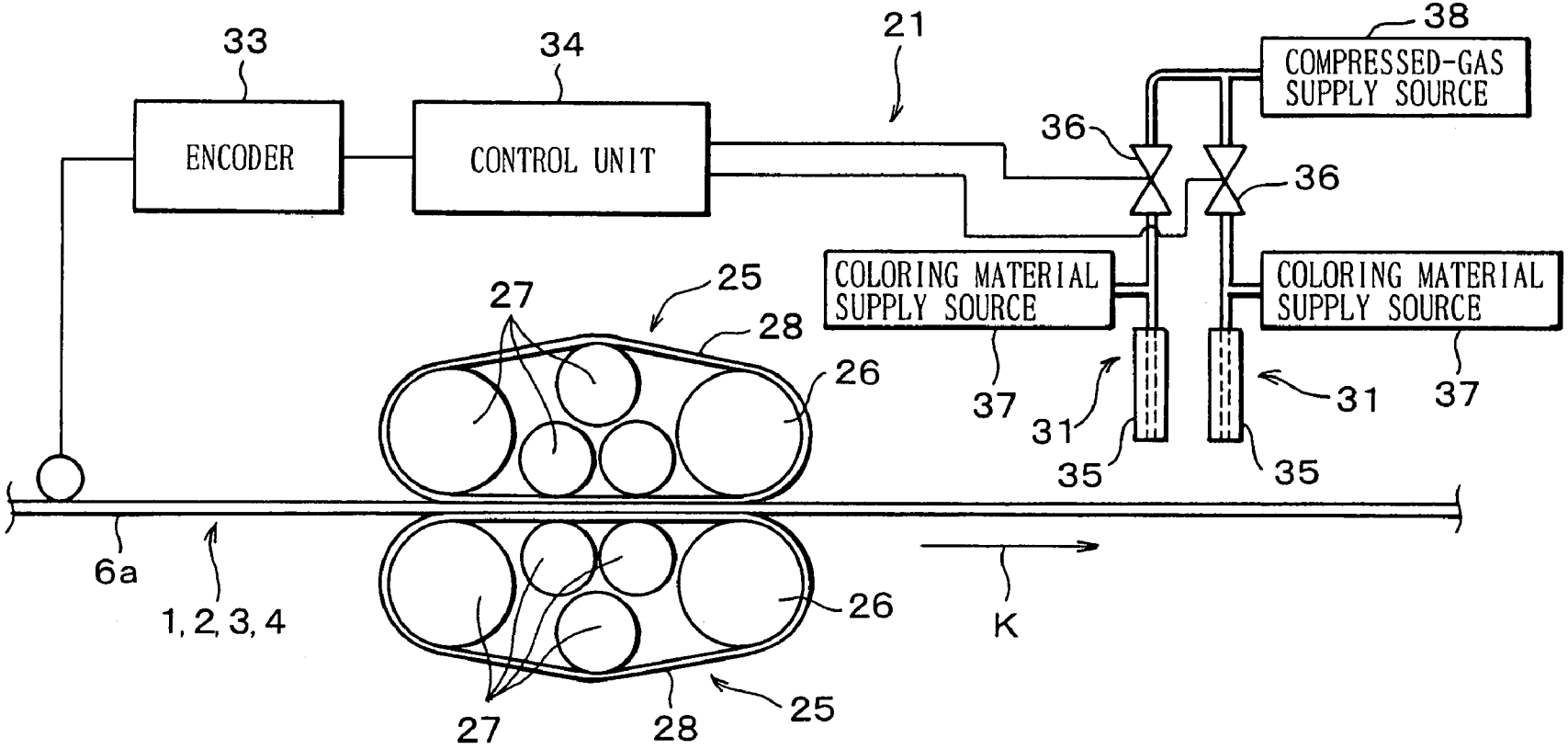
FIG. 10 is a diagram, showing a structure of the marking machine shown FIG. 9.

The marking machine 21 is for forming the first, second, third and fourth marks 7, 8, 9, 10 on the outer surfaces 6*a* of the first, second, third and fourth covered wires 1, 2, 3, 4. The marking machine 21 has a plurality of coloring units 31, an encoder 33 as sensing means and-a control unit 34 as shown in FIG. 10. Two coloring units 31 are provided in FIG. 10. The plurality of coloring units 31 is disposed along the arrow K.

The plurality of coloring units 31 is disposed between the pair of belt-conveying units 25 of the measuring device 23 and the pair of cutting blades 29, 30 of the cutting device 24. Each of the coloring units 31 has a nozzle 35 and a valve 36. The nozzle 35 opposes to the first, second, third and fourth covered wires 1, 2, 3, 4 conveyed along the arrow K by the pair of belt-conveying units 25. Liquid coloring material of required color R, G, Q or S is supplied into the nozzle 35 from a coloring material supply source 37 (shown in FIG. 10). The coloring material is one selected from a group of aforesaid the first color R, the second color G, the third color Q and the fourth color S.

The valve 36 is joined with the nozzle 35. The valve 35 is also joined with a compressed-gas supply source 38 (shown in FIG. 10.). The compressed-gas supply source 38 supplies compressed gas through the valve 36 to the nozzle 35. When the valve 36 is opened, the coloring material in the nozzle 35 is spouted (drop-jetted) against the outer surface 6*a* of the first, second, third or fourth covered wires 1, 2, 3, 4 by compressed gas supplied from the compressed-gas supply source 38.

When the valve 36 is closed, spouting (drop-jetting) the coloring material from the nozzle 35 is stopped. In the coloring unit 31 having aforesaid structure, the valve 36 is opened in a predetermined period and a predetermined amount of the coloring material of required color R, G, Q or S is spouted (drop-jetted) against the outer surface 6*a* of the first, second, third or fourth covered wires 1, 2, 3, 4 in compliance with signals of the control unit 34.

The coloring material is liquid material dissolving and dispersing color material (industrial organic material) in solvent, such as water. There are dyestuffs and pigments (almost all thereof are organic and synthetic) as the organic material, and in case, some dyestuffs are used as pigments or some pigments are used as dyestuffs. Physically, the coloring material in this specification means the both of coloring liquid and paint.

The coloring liquid means what dissolves or disperses dyestuff in solvent. The paint means disperses pigment in fluid dispersion. To adhere the coloring liquid on the outer surface 6*a* of the first, second, third or fourth covered wires 1, 2, 3, 4, the dyestuff penetrates into the cover portion 6. To adhere paint on the outer surface 6*a* of the first, second, third or fourth covered wires 1, 2, 3, 4, the pigment adheres on the outer surface 6*a* without penetrating into the cover portion 6.

Thus, the coloring unit 31 dyes a part of the outer surface 6*a* of the first, second, third or fourth covered wires 1, 2, 3, 4 with dyestuff, or paint the outer surface 6*a* of the first, second, third or fourth covered wires 1, 2, 3, 4 with pigment. Thereby, meaning of marking (coloring) the outer surface 6*a* of the first, second, third or fourth covered wires 1, 2, 3, 4 includes both of dying a part of the outer surface 6*a* of the first, second, third or fourth covered wires 1, 2, 3, 4 with dyestuff and painting a part of the outer surface 6*a* of the first, second, third or fourth covered wires 1, 2, 3, 4 with pigment.

The solvent and the liquid dispersion have preferably affinity to the synthetic resin used for the cover portion 6. Thereby, the dyestuff can penetrate securely into the cover portion 6 or the pigment can adhere securely on the outer surface 6*a* of the cover portion 6.

Drop-jet herein means that some amounts of droplets of the liquid coloring material are jetted against the outer surface 6*a* of the covered wires 1, 2, 3, 4 from the nozzle 35 of the coloring unit 31. Therefore, the nozzle 35 of the coloring unit 31 on the marking machine 21 jets some amounts of droplets of the liquid coloring material against the outer surface 6*a* of the covered wires 1, 2, 3, 4.

The encoder 33 measures information based on a moving length and moving speed of the first, second, third or fourth covered wires 1, 2, 3, 4 and outputs the information to the control unit 34. The control unit 34 is a computer having a ROM, a RAM and a CPU to perform control for the whole marking machine 21 by connecting with the encoder 33 and the valve 36 mentioned above.

The control unit 34 stores lengths L1, L2, L3 and L4 of marks 7, 8, 9 and 10 formed on the outer surface 6*a* of the first, second, third or fourth covered wires 1, 2, 3, 4, and the aforesaid spaces D1, D2, D3, D4, D5 and D5. In other words, the control unit 34 stores patterns of marks 7, 8, 9 and 10 formed on the outer surface 6*a* of the first, second, third or fourth covered wires 1, 2, 3, 4.

The control unit 34 stores information of a distance between the nozzles 35 of the coloring units 31. The control unit 34 controls the valve 36 to be opened and close in compliance with signals of the aforesaid encoder 33 so that the coloring material is spouted (drop-jetted) from the nozzles 35 of the coloring unit 31 so as to form the mark 7, 8, 9 or 10 on the outer surface 6*a* of the first, second, third or fourth covered wires 1, 2, 3, 4.

Thus, the marking machine 21 having aforesaid structure forms the first, second, third and fourth marks 7, 8, 9, 10 on the outer surfaces 6*a* of the first, second, third and fourth covered wires 1, 2, 3, 4. Physically, when the marks are on the outer surfaces 6*a* of the first, second, third and fourth covered wires 1, 2, 3, 4, the pair of belt-conveying units 25 of the wire cutting apparatus 20 conveys the first, second, third and fourth covered wires 1, 2, 3, 4 along the arrow K.

Thereafter, the control unit 34 controls the valve 36 so as to spout (drop-jet) predetermined amount of the liquid coloring material from the nozzles 35 of the coloring unit 31 against the outer surface 6*a* of the first, second, third or fourth covered wires 1, 2, 3, 4. Predetermined patterns of the first, second, third and fourth marks 7, 8, 9, 10 on the outer surfaces 6*a* of the first, second, third and fourth covered wires 1, 2, 3, 4 are formed.

After the pair of belt-conveying units 25 of the wire cutting apparatus 20 conveys the predetermined lengths of the first, second, third and fourth covered wires 1, 2, 3, 4, the pair of belt-conveying units 25 stops. The cutting blades 29, 30 of the cutting device 24 cut the first, second, third and fourth covered wires 1, 2, 3, 4 formed with the first, second, third and fourth marks 7, 8, 9, 10 on the outer surfaces 6*a* thereof. Thereby, the first, second, third and fourth covered wires 1, 2, 3, 4 formed with the first, second, third and fourth marks 7, 8, 9, 10 on the outer surfaces 6*a* thereof as shown in FIG. 1A-8B are manufactured.

In this embodiment, the first mark 7 and the second mark 8 are disposed with a gap along lengthwise of the first and second covered wires 1, 2. Thereby, the widths H1, H2 (shown in FIG. 1A, 2A) along the circumference of the first mark 7 and the second mark of the first and second covered wires 1, 2 can be increased. Therefore, the first mark 7 and the second mark 8 can be easily recognized by visual check.

The length L1 of the first mark 7 is made longer than the length L2 of the second mark 8 and these marks 7, 8 are disposed with a gap to each other. Thereby, the first mark 7 and the second mark 8 can be easily recognized and easily distinguished from each other, and the first color R and the second color G can be easily distinguished. The first color R and the second color G can be changed properly. Therefore, many various covered wires 1, 2 can be manufactured by means of combinations of the first color R and the second color G.

Since the first mark 7 and the second mark 8 can be easily recognized, and the marks 7, 8 can be easily distinguished from each other, and the first color R and the second color G can be easily recognized, the covered wires 1, 2 can be easily distinguished by means of the combinations of the first color R and the second color G. Therefore, in assembling the wire harness, wiring the covered wires 1, 2 can be prevented from mistakes, and deterioration of quality of the wire harness can be prevented.

One of the first mark 7 and the second mark 8 of the second covered wire 2 is divided into a plurality of pieces. A plurality of marks 7*a* or 8*a* formed by dividing is disposed with a gap to each other along lengthwise of the cover potion 6, i.e. lengthwise of the second covered wire 2. Thereby, the widths H1, H2 of the marks 7*a*, 8*a* can be increased, and the marks 7*a* and 8*a* can be easily recognized.

It is easily recognized which one of the first mark 7 and the second mark 8 is divided. The first covered wire 1 and the second covered wire 2 are easily distinguished by checking which one of the first mark 7 and the second mark 8 is divided. In other words, it can be distinguished whether or not the covered wire is the second covered wire 2 having the predetermined wire diameter. Therefore, the wire diameters R1, R2 of the covered wires 1, 2 can be easily recognized and the covered wires 1, 2 can be easily distinguished.

The third marks 9 are disposed with a gap along lengthwise of the third and fourth covered wires 3, 4. Thereby, the widths H3 (shown in FIG. 7A) along the circumference of the third and fourth covered wires 3, 4 of the third mark 9 can be increased. Therefore, the third mark 9 can be easily recognized even if the third and fourth covered wires 3, 4 would be thinner. The third color Q of the third mark 9 can be easily recognized. Furthermore, the third color Q may be changed properly. Therefore, many various covered wires 3, 4 can be manufactured by means of changing the third color properly.

Since the third mark 9 can be easily recognized, and the third color Q can be easily recognized, the third and fourth covered wires 3, 4 can be easily distinguished from each other. Therefore, in assembling the wire harness, wiring the covered wires 3, 4 can be prevented from mistakes, and deterioration of quality of the wire harness can be prevented.

The third marks 9 are disposed in the same third color Q with a gap along lengthwise of the third and fourth covered wires 3, 4. On the other hand, the first mark 7 and the second mark 8 extend in a straight line. Thereby, the third mark 9 can be easily distinguished from the first and second marks 7, 8. Therefore, the third and fourth covered wires 3, 4 can be easily distinguished from the first and second covered wires 1, 2.

The plurality of fourth marks 10 is disposed between the third marks 9 of the fourth covered wire 4. The marks 10 are disposed with a gap from each other and the third marks 9 along lengthwise of the fourth covered wire 4. Thereby, the width H4 of the fourth mark 10 (shown in FIG. 8A) can be increased, and the fourth marks 10 can be easily recognized.

It can be easily recognized whether or not the fourth mark 10 exists between the third marks 9. Therefore, the third covered wire 3 and the fourth covered wire 4 can be easily distinguished by checking whether or not the fourth mark 10 exists. In other words, it can be distinguished whether or not the covered wire is the second covered wire 2 having the predetermined wire diameter. Thereby, the wire diameters R3, R4 of the covered wires 3, 4 can be easily distinguished so that the covered wires 3, 4 can be easily distinguished from each other.

The first, second, third and fourth marks 7, 8, 9, 10 are formed on the outer surfaces 6*a* of the first, second, third and fourth covered wires 1, 2, 3, 4. By coloring with predetermined colors on the outer surface 6*a* of the covered wires pre-produced in unicolor P, the first, second, third and fourth covered wires 1, 2, 3, 4 can be manufactured.

By changing a color of the coloring material, many various covered wires 1, 2, 3, 4 can be manufactured. The amount of the covered wires 1, 2, 3, 4 to be stored in a factory for manufacturing them and a workshop for assembling by using them can be reduced. Therefore, the manufacturing cost of the covered wires 1, 2, 3, 4 and products with the covered wires 1, 2, 3, 4 can be reduced.

In the aforesaid embodiment, color of the outer surface 6*a* of the first, second, third, fourth covered wires 1, 2, 3, 4 is white. According to this invention, by not coloring the synthetic resin to form the cover portion 6, the outer surface 6*a* of the cover portion 6 may be uncolored. The unicolor P of the outer surface 6*a* of the cover portion 6 may be relatively bright color having lightness over eight defined for each hue in Japan Industrial Standard.

In the aforesaid embodiment, the first mark 7 and the second mark 8 are disposed alternatively along lengthwise of the first covered wire 1 and the second covered wire 2. Many first marks 7 and second marks 8 are provided on the outer surface 6*a* throughout the length of the first covered wire 1 and the second covered wire 2. According to this invention, the aforesaid first mark 7 and second mark 8 may be provided only at required area such as an end area of the covered wire as shown in FIGS. 11A, 11B and 11C.

Figures 11A, 11B, 11C:
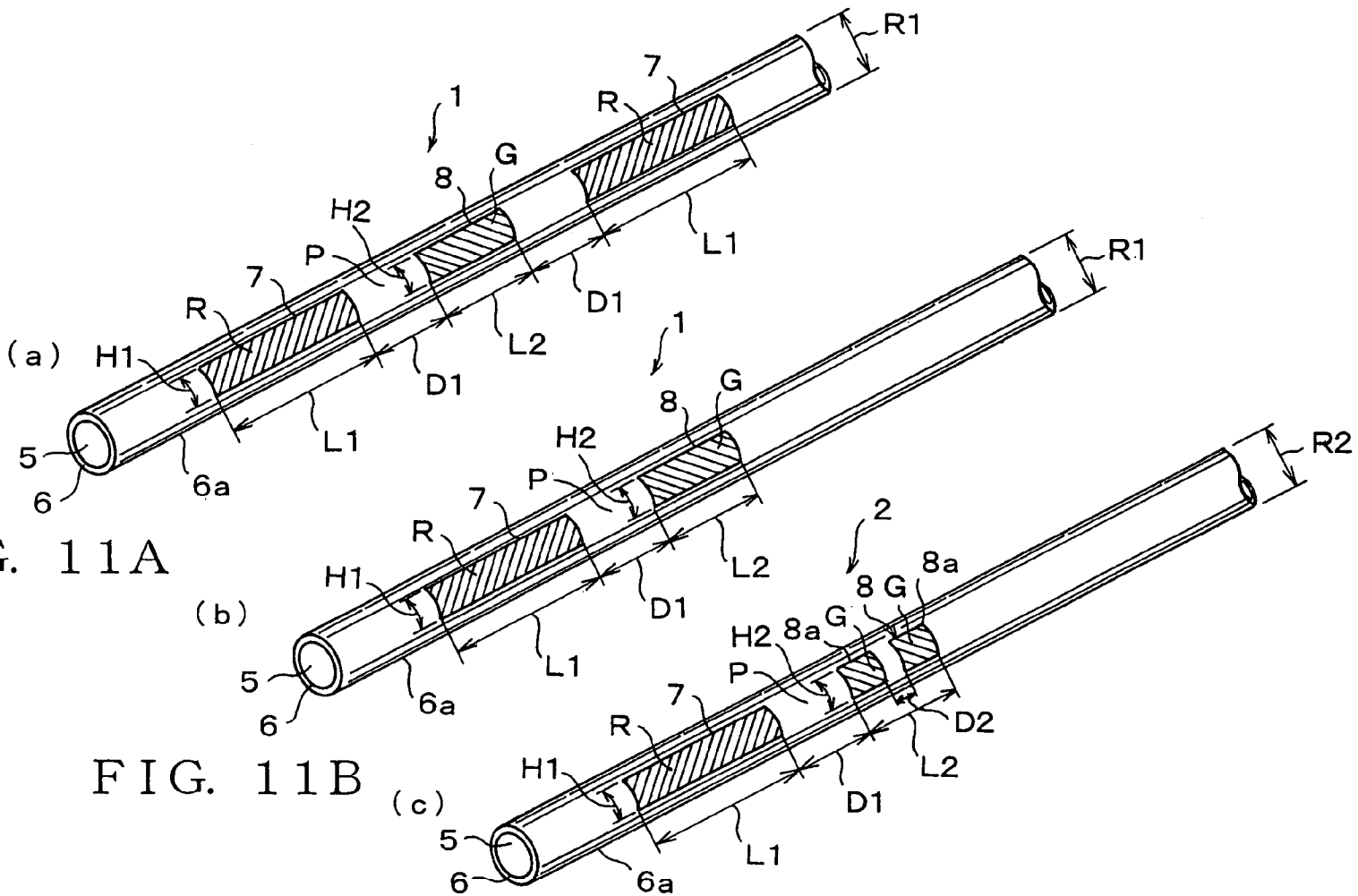
FIG. 11A is a perspective view of a further modified example of the first covered wire shown in FIG. 1A.
FIG. 11B is a perspective view of a further modified example of the first covered wire shown in FIG. 1A.
FIG. 11C is a perspective view of a further modified example of the second covered wire shown in FIG. 2A.

In FIG. 11A, two first marks 7 and one second mark 8 between these first marks 7 are provided at the end area of the first covered wire 1. In FIG. 11B, one first mark 7 and one second mark 8 are respectively provided at the end area of the first covered wire 1. In FIG. 11C, one first mark 7 and one second mark 8 are respectively provided at the end area of the second covered wire 2. Since one first mark 7 and one second mark 8 are respectively provided at the end area of the first and second covered wires 1, 2 in FIG. 11B, 11C, amount of coloring material for forming the first and second marks 7, 8 can be reduced so that manufacturing cost of the covered wires 1, 2 can be more reduced.

Furthermore, when the first mark 7 and the second mark 8 are formed during conveying the covered wires 1, 2 by not-shown rollers, amount of the coloring material adhering on the not-shown rollers can be reduced. Therefore, amount of coloring material for coloring the covered wires 1, 2 can be reduced so that manufacturing cost of the covered wires 1, 2 can be more reduced.

Figure 12A:
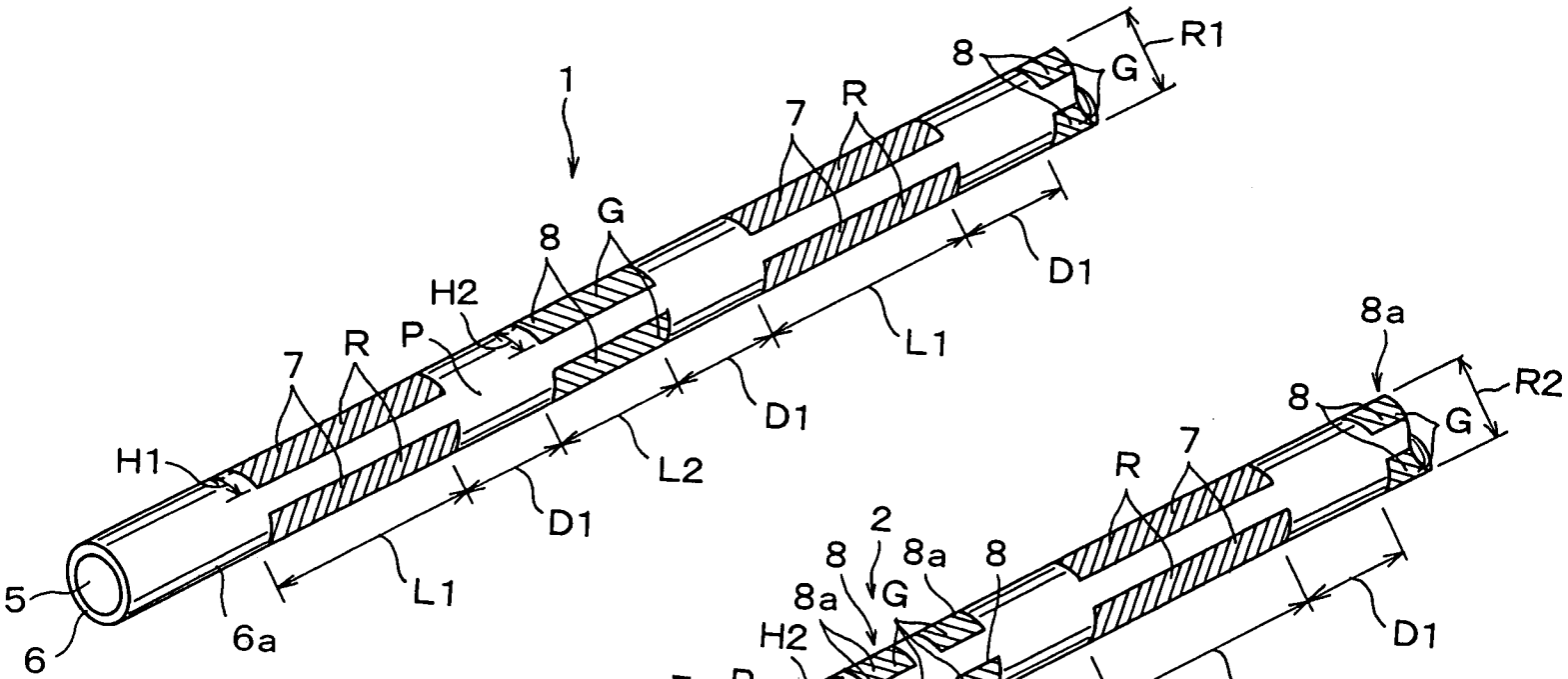
FIG. 12A is a perspective view of a further modified example of the first covered wire shown in FIG. 1A.
Figure 12B:
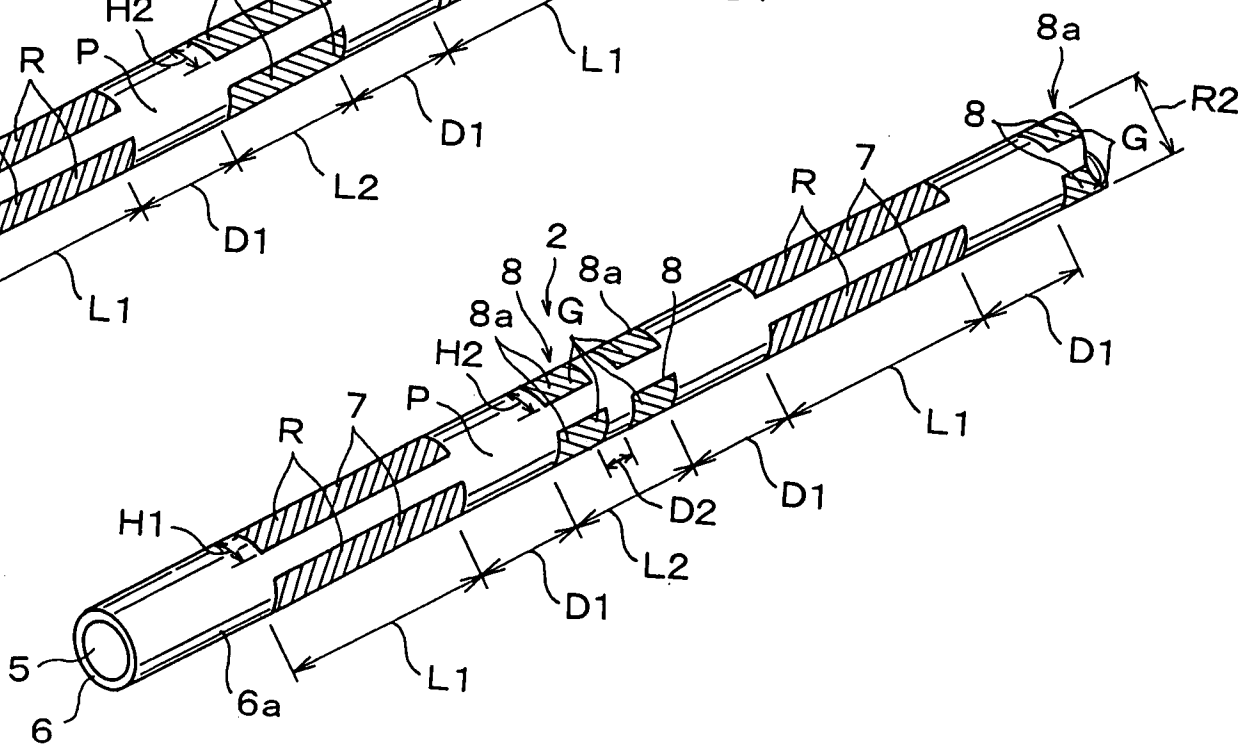
FIG. 12B is a perspective view of a further modified example of the second covered wire shown in FIG. 2A.
Figure 13A:
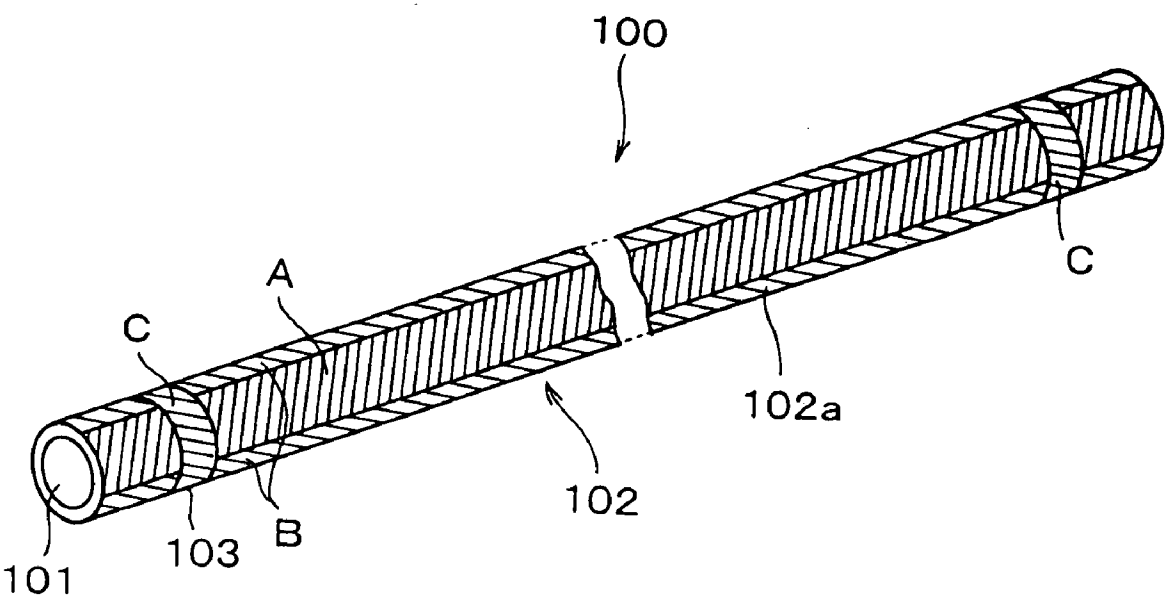
FIG. 13A PRIOR ART
FIG. 13A is a perspective view of an covered wire by prior art.
Figure 13B:
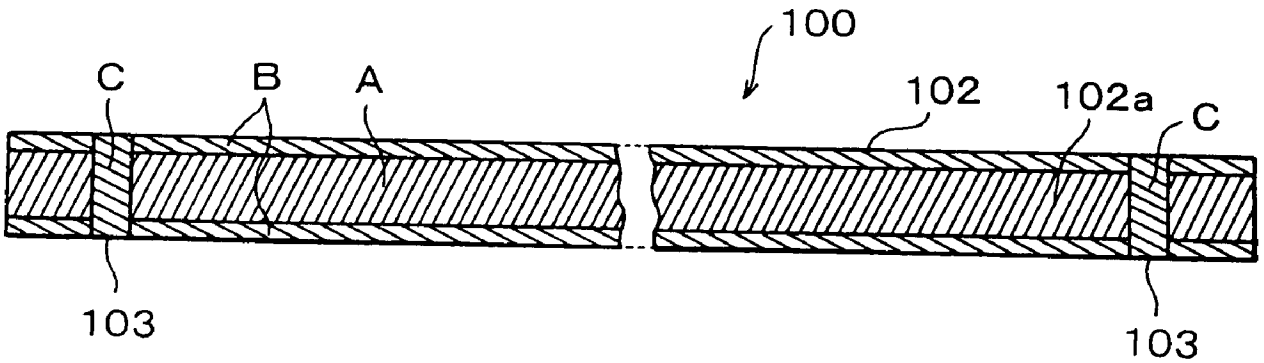
FIG. 13B PRIOR ART
FIG. 13B is a side view of the covered wire shown in FIG. 13A.

According to this invention, a plurality of the first, second, third and fourth marks 7, 8, 9, 10 may be disposed along the circumference of the outer surface 6*a* of the covered wires 1, 2, 3, 4. In FIG. 12A, 12B, a plurality of the first and second marks 7, 8 are disposed along the circumference of the outer surface 6*a* of the covered wires 1, 2.

In the aforesaid embodiment, the second mark 8 of the second covered wire 2 is divided into two pieces. According to this invention, the wire diameters R1, R2 may be distinguished by dividing the first mark 7 into two pieces. Furthermore, the wire diameters R1, R2 may be distinguished by dividing the first mark 7 or the second mark 8 into three pieces or more. Thus, according to this invention, the wire diameters R1, R2 can be distinguished by dividing one of the first mark 7 and the second mark 8 into a plurality of pieces. According to this invention, the wire diameters R3, R4 can be distinguished by disposing a plurality of the fourth marks 10 between a pair of the third marks 9.

The marking machine 21 is mounted on the wire cutting apparatus 20. Thereby, when the first, second, third, fourth covered wires 1, 2, 3, 4 having long length are cut into predetermined lengths, required marks can be marked on the first, second, third, fourth covered wires 1, 2, 3, 4. Therefore, process for manufacturing the first, second, third, fourth covered wires 1, 2, 3, 4 can be reduced.

In the aforesaid embodiment, the marking machine 21 has two coloring units 31. According to this invention, three or more coloring units 31 can be mounted.

In the aforesaid embodiment, the first, second, third and fourth marks 7, 8, 9, 10 are formed by spouting (drop-jetting) constant amount of liquid color material against the outer surface 6*a* of the first, second, third or fourth covered wires 1, 2, 3, 4. According to this invention, the first, second, third and fourth marks 7, 8, 9, 10 can be formed by soaking (impregnating) a part of the outer-surface 6*a* of the first, second, third or fourth covered wires 1, 2, 3, 4 in coloring material. The first, second, third and fourth marks 7, 8, 9, 10 can also be formed by spraying the coloring material with compressed gas as aerosol on a part of the outer surface 6*a* of the first, second, third or fourth covered wires 1, 2, 3, 4.

According to this invention, the marking machine 21 can be also mounted on the other apparatus used at various processes for the first, second, third or fourth covered wires 1, 2, 3, 4.

In the aforesaid embodiment, the control unit 34 is provided with a computer having a ROM, a RAM and a CPU.

According to this invention, the control unit 34 can be provided with usual digital circuits. In this case, a circuit for counting pulse signals from the encoder 33 and a circuit for judging to open the valve 36 by counting predetermined number of the pulse signals are preferably used.

In the aforesaid embodiment, the first, second, third or fourth covered wires 1, 2, 3, 4 forming the wire harness wired in the car are described. According to this invention, the first, second, third or fourth covered wires 1, 2, 3, 4 can be uses for various electronic devices and various electric devices such as a portable computer.

According to this invention, acrylic paint, ink (dyestuff or pigment) and UV ink can be also used as coloring liquid or paint.

EFFECTS OF THE INVENTION

According to claim 1 of this invention, the first mark and the second mark are disposed along lengthwise of the cover portion, i.e. lengthwise of the covered wire. Thereby, the widths of the first mark and the second mark along the circumference of the covered wire can be increased. Therefore, when the covered wires are thinner, the first mark and the second mark can be easily recognized and the marks can be easily distinguished. Furthermore, the length of the first mark is longer than that of said second mark, and the marks are disposed alternately with a gap. Thereby, the first mark and the second mark can be distinguished from each other.

Therefore, the first mark and the second mark can be easily recognized and easily distinguished from each other, so that the covered wires can be easily distinguished from each other. Therefore, in assembling the wire harness, wiring the covered wires can be prevented from mistakes, and deterioration of quality of the wire harness can be prevented.

The first mark and the second mark are formed on the outer surface. Therefore, many various covered wires can be manufactured by properly selecting the first color and the second color for the pre-produced covered wire having a unicolor outer surface. The amount of the covered wires to be stored in a factory for manufacturing them and a workshop for assembling by using them can be reduced. Therefore, the manufacturing cost of the covered wires and products with the covered wires can be reduced.

According to claim 2 of this invention, one first mark and one second mark are respectively disposed at the end area of the covered wire. Therefore, amount of coloring material for forming the first and second marks can be reduced so that manufacturing cost of the covered wires can be more reduced.

Furthermore, when the first mark and the second mark are formed during conveying the covered wires by not-shown rollers, amount of the coloring material adhering on the not-shown rollers can be reduced. Therefore, amount of coloring material for coloring the covered wires can be reduced so that manufacturing cost of the covered wires can be more reduced.

According to claim 3 of this invention, diameters of the covered wires are distinguished by the means for distinguishing wire diameters. Thereby, the covered wires can be easily distinguished.

According to claim 4 of this invention, the means for distinguishing wire diameters is provided with one of the first mark and the second mark divided to plural pieces. Thereby, diameters of the covered wires can be easily distinguished by recognizing divided one of the first mark and the second mark. Therefore, the covered wires can be easily distinguished.

According to claim 5 of this invention, the third marks are disposed with a gap therebetween along lengthwise of said covered wire. Thereby, the third marks are easily distinguished from the cover portion so that the third marks are easily distinguished. Therefore, covered wires can be easily distinguished from each other.

Furthermore, the third marks are formed on the unicolor outer surface. Thereby, many various covered wires can be manufactured by selecting the third color properly for the pre-produced covered wire with a unicolor outer surface. Therefore, amount of the covered wires to be stored in a factory for manufacturing them and a workshop for assembling by using them can be reduced. Therefore, the manufacturing cost of the covered wires and products with the covered wires can be reduced.

According to claim 6 of this invention, the means for distinguishing wire diameters can distinguish wire diameters of covered wires. Thereby, the covered wires can be easily distinguished.

According to claim 7 of this invention, the means for distinguishing wire diameters is a plurality of fourth marks provided between the third marks. Furthermore, the fourth marks are disposed along the lengthwise of the covered wire, and the forth color is different from the third color. Thereby, the fourth marks are easily recognized so that the wire diameters of the covered wires can be easily distinguished by checking the fourth marks. Thus, the covered wires can be easily distinguished.

According to claim 8 of this invention, the first mark and the second mark are disposed with a gap along lengthwise of the covered wire. Thereby, the widths of the first mark and the second mark along the circumference of the covered wire can be increased. Therefore, the first mark and the second mark can be easily recognized. Furthermore, a length of the first mark is made longer than that of the second mark, and these marks are disposed with a gap therebetween. Therefore, the first mark and the second mark can be distinguished from each other. The colors of the first color and the second color are changed properly.

Since the first mark and the second mark can be easily recognized, and the marks can be easily distinguished from each other, and the first color and the second color can be easily recognized, the covered wires can be easily distinguished. Furthermore, many various covered wires can be manufactured by means of combinations of the first color and the second color. The covered wires can be easily distinguished by means of the combinations of the first color and the second color. Therefore, in assembling the wire harness, wiring the covered wires can be prevented from mistakes, and deterioration of quality of the wire harness can be prevented.

The first mark and the second mark are formed on the unicolor outer surface of the covered wire. Therefore, many various covered wires can be manufactured by properly selecting the first color and the second color for the pre-produced covered wire having a unicolor outer surface. The amount of the covered wires to be stored in a factory for manufacturing them and a workshop for assembling by using them can be reduced. Therefore, the manufacturing cost of the covered wires and products with the covered wires can be reduced.

According to claim 9 of this invention, diameters of the covered wires can be distinguished by recognizing divided one of the first mark and the second mark. Thereby, the covered wires can be more easily distinguished.

According to claim 10 of this invention, the third marks are disposed with a gap along lengthwise of the covered wire. Thereby, the widths of the third marks along the circumference of the covered wire can be increased. Therefore, the third marks can be easily recognized and then the third color of the third marks can be easily distinguished. The third color is changed properly.

Since the third marks can be easily recognized, and the third color can be easily recognized, the covered wires can be easily distinguished from each other. Furthermore, many various covered wires can be manufactured by means of changing the third color. The covered wires can be easily distinguished by the third color. Therefore, in assembling the wire harness, wiring the covered wires can be prevented from mistakes, and deterioration of quality of the wire harness can be prevented.

The third marks are formed on the unicolor outer surface of the covered wire. Therefore, many various covered wires can be manufactured by properly selecting the third color for the pre-produced covered wire having a unicolor outer surface. The amount of the covered wires to be stored in a factory for manufacturing them and a workshop for assembling by using them can be reduced. Therefore, the manufacturing cost of the covered wires and products with the covered wires can be reduced.

According to claim 11 of this invention, the outer diameter of the covered wire can be easily distinguished by recognizing existence of the plurality of fourth marks between the third marks. Furthermore, the fourth marks are disposed along the lengthwise of the covered wire. Thereby, the fourth marks can be easily recognized and then the diameters of the covered wires can be easily distinguished. Thus, the covered wires can be easily distinguished.

What is claimed is:

1. A covered wire having an electrical conductive core and a unicolor cover portion of synthetic resin for covering said core comprising:

a first mark being formed by coloring a part of an outer surface of said cover portion with a first color; and a second mark being formed by coloring the other part of said outer surface of said cover portion with a second color different from said first color, whereby said first mark and said second mark are disposed alternately with a gap along lengthwise of said covered wire, and a length of said first mark along the lengthwise of said covered wire is longer than that of said second mark along the lengthwise mark of said covered wire, wherein the first and second marks are made by spouting a predetermined amount of a liquid coloring material of the color against the outer surface of the cover portion of the covered wire from a plurality of nozzles, all of which being oriented in the same direction perpendicular to the wire.

2. The covered wire according to claim 1, wherein one of said first marks and one of said second marks are disposed respectively at an end area of said covered wire.

3. The covered wire according to claim 2, further comprising means for distinguishing wire diameters as capable to distinguish outer diameters of said cover portions.

4. The covered wire according to claim 3, wherein said means for distinguishing wire diameters is a plurality of marks provided with one of said first mark and said second mark divided to plural pieces, and disposed along the lengthwise of said covered wire.

5. The covered wire according to claim 1 further comprising means for distinguishing wire diameters as capable to distinguish outer diameters of said cover portions.

6. The covered wire according to claim 5, wherein said means for distinguishing wire diameters is a plurality of marks provided with one of said first mark and said second mark divided to plural pieces, and disposed along the lengthwise of said covered wire.

7. The covered wire according to claim 1, wherein said coloring material is a liquid material dissolving and dispersing color material in a solvent.

8. The covered wire according to claim 1, wherein each liquid coloring material is supplied in a nozzle joined with a valve, which is joined with a compressed-gas supply source, and is spouted by the compressed-gas supplied from the compressed-gas supply source when the valve is opened.

9. A covered wire having an electrical conductive core and a unicolor cover portion of synthetic resin for covering said core comprising:

a plurality of marks being formed by coloring a part of an outer surface of said cover portion with a color, said marks being disposed with a gap therebetween along lengthwise of said covered wire, wherein the marks are made by spouting a predetermined amount of a liquid coloring material of the color against the outer surface of the cover portion of the covered wire from a plurality of nozzles, all of which nozzles are oriented in the same direction toward a same side of the wire in a lengthwise direction of the wire.

10. The covered wire according to claim 9, further comprising means for distinguishing wire diameters as capable to distinguish outer diameters of said cover portions.

11. The covered wire according to claim 6, wherein said means for distinguishing wire diameters is a plurality of further marks provided with plural pieces thereof between a pair of said marks adjacent to each other by coloring a part of said outer surface of said cover portion with a further color different from said color and disposed with a space along the lengthwise of said covered wire.

12. The covered wire according to claim 9, wherein said coloring material is a liquid material dissolving and dispersing color material in a solvent.

13. The covered wire according to claim 9, wherein each said nozzle is joined with a valve, which is joined with a compressed-gas supply source, and is spouted by the compressed-gas supplied from the compressed-gas supply source when the valve is opened.

14. A method of distinguishing covered wires comprising steps of:

forming a first mark by coloring a part of an outer surface of a unicolor covered wire with a first color; and forming a second mark by coloring the other part of said outer surface with a second color different from the first color, whereby said first mark and said second mark are disposed alternately with a gap along lengthwise of said covered wire, and a length of said first mark along the lengthwise of said covered wire is longer than that of said second mark along the lengthwise of said covered wire, and colors for said first color and said second color are selected as capable to distinguish each covered wire, wherein the first mark and second mark are made respectively by spouting a predetermined amount of a liquid coloring material of required color against the outer surface of the cover portion of the covered wire from a plurality of nozzles, all of which being oriented in the same direction perpendicular to the wire.

15. The method of distinguishing covered wires according to claim 14, wherein one of said first mark and said second mark is divided to plural pieces as capable to distinguish outer diameters of said covered wires, and disposed along the lengthwise of said covered wire.

16. The method of distinguishing covered wires according to claim 14, wherein said coloring material is a liquid material dissolving and dispersing color material in a solvent.

17. The method of distinguishing covered wires according to claim 14, wherein each liquid coloring material is supplied in a nozzle joined with a valve, which is joined with a compressed-gas supply source, and is spouted by the compressed-gas supplied from the compressed-gas supply source when the valve is opened.

18. A method of distinguishing covered wires comprising a step of forming a plurality of marks being formed by coloring a part of an outer surface of a unicolor covered wire with a color, said marks being disposed with a gap therebetween along lengthwise of said covered wire, whereby said color is selected respectively for said covered wires as capable to distinguish each covered wire, wherein each said mark is made by spouting a predetermined amount of a liquid coloring material of the color against the outer surface of the cover portion of the covered wire from a plurality of nozzles, all of which nozzles are oriented in the same direction toward a same side of the wire in a lengthwise direction of the wire.

19. The method of distinguishing covered wires according to claim 18, further comprising steps of forming a plurality of further marks between a pair of said marks adjacent to each other by coloring the other part of said outer surface of said cover portion with a further color different from said color as capable to distinguish the outer diameters of said covered wires, the plurality of further marks being disposed along the lengthwise of said covered wire.

20. The method of distinguishing covered wires according to claim 18, wherein said coloring material is a liquid material dissolving and dispersing color material in a solvent.

21. The method of distinguishing covered wires according to claim 18, wherein the liquid coloring material is supplied in a nozzle joined with a valve, which is joined with a compressed-gas supply source, and is spouted by the compressed-gas supplied from the compressed-gas supply source when the valve is opened.

* * * * *